US010118270B2

(12) United States Patent
Jin et al.

(10) Patent No.: US 10,118,270 B2
(45) Date of Patent: Nov. 6, 2018

(54) POST-PROCESS TOOL

(71) Applicant: HYUNDAI MOTOR COMPANY, Seoul (KR)

(72) Inventors: Taeheun Jin, Gyeongsan-si (KR); Minsun Sim, Incheon (KR); Chaewon Lim, Seongnam-si (KR); Ki Soon Kim, Ulsan (KR); Yunheui Lee, Seoul (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 65 days.

(21) Appl. No.: 15/365,450

(22) Filed: Nov. 30, 2016

(65) Prior Publication Data

US 2017/0320186 A1 Nov. 9, 2017

(30) Foreign Application Priority Data

May 4, 2016 (KR) ..... 10-2016-0055336

(51) Int. Cl.
*B24B 7/18* (2006.01)
*B24B 49/12* (2006.01)
*B24B 51/00* (2006.01)

(52) U.S. Cl.
CPC ..... *B24B 7/18* (2013.01); *B24B 49/12* (2013.01); *B24B 51/00* (2013.01)

(58) Field of Classification Search
CPC ..... B24B 7/18; B24B 49/12; B24B 51/00
USPC ..... 451/5, 6, 342, 461, 463, 66
See application file for complete search history.

(56) References Cited

U.S. PATENT DOCUMENTS 4,551,902 A * 11/1985 Thibaut ..... B24B 45/00 451/342
4,864,777 A * 9/1989 McLaughlin ..... B24B 49/12 451/5
5,067,085 A * 11/1991 Wenzel ..... B25J 9/1684 700/164
5,077,941 A * 1/1992 Whitney ..... B24B 19/26 451/11
5,299,389 A * 4/1994 Yonaha ..... B25J 9/1684 451/11
5,509,848 A * 4/1996 Shimbara ..... B23Q 1/5456 451/24
5,545,079 A * 8/1996 Larsson ..... B23D 45/006 125/13.01
6,390,888 B1 * 5/2002 Amano ..... B24B 23/00 451/24

(Continued)

FOREIGN PATENT DOCUMENTS

KR 20-1998-0024255 U 7/1998
KR 10-2009-0027927 A 3/2009

(Continued)

*Primary Examiner* — George Nguyen
(74) *Attorney, Agent, or Firm* — McDermott Will & Emery LLP

(57) ABSTRACT

A post-process tool includes: a fixing bracket mounted in at least one robot; and a grinding assembly installed at one side of the fixing bracket, being moved in a longitudinal direction of the vehicle body, and configured to grind a lamination region. The grinding assembly includes a grinding bracket mounted at the one side of the fixing bracket, a grinding motor reciprocatably installed in the grinding bracket and moving in upward and downward directions; and a grinding wheel coupled to a drive shaft of the grinding motor.

30 Claims, 14 Drawing Sheets

(56) References Cited

U.S. PATENT DOCUMENTS

| | | | | |
|---|---|---|---|---|
| 6,876,899 | B2 * | 4/2005 | DeCord, Jr. | B22D 31/00 451/5 |
| 7,083,505 | B2 * | 8/2006 | Carlson, III | B24B 27/0076 451/302 |
| 2005/0032460 | A1 * | 2/2005 | Takatsuji | B24B 9/107 451/5 |
| 2007/0281588 | A1 * | 12/2007 | Hirose | B24B 17/06 451/11 |
| 2009/0011691 | A1 * | 1/2009 | L'Helgoualc'h | B24B 9/00 451/296 |
| 2010/0261411 | A1 * | 10/2010 | Reinmoeller | B24B 17/00 451/5 |
| 2012/0208441 | A1 * | 8/2012 | Kawai | B24B 9/06 451/461 |
| 2013/0316618 | A1 * | 11/2013 | Lee | B24B 9/10 451/5 |
| 2015/0099425 | A1 * | 4/2015 | Trnka | B24B 1/00 451/6 |
| 2015/0111471 | A1 * | 4/2015 | Yoshihara | B24B 21/08 451/5 |
| 2015/0375390 | A1 * | 12/2015 | Becroft | B25J 9/0018 427/427.2 |

FOREIGN PATENT DOCUMENTS

| | | | |
|---|---|---|---|
| KR | 10-2011-0000399 | A | 1/2011 |
| KR | 10-2013-0007842 | A | 1/2013 |

* cited by examiner

110

POST-PROCESS TOOL

CROSS-REFERENCE TO RELATED APPLICATION

This application claims the benefit of priority to Korean Patent Application No. 10-2016-0055336, filed in the Korean Intellectual Property Office on May 4, 2016, the entire disclosure of which is incorporated herein by reference.

TECHNICAL FIELD

The present disclosure relates to a vehicle body assembly system. More particularly, the present disclosure relates to a post-process tool for assembling a side panel and a loop panel of a vehicle body.

BACKGROUND

In general, a vehicle body has a white body (B.I.W) form by treating a vehicle body assembly process of assembling various product panels produced in a vehicle body sub-process.

The vehicle body includes a floor panel forming a lower surface of a frame, both side panels forming left and right sides of the frame, a loop panel forming an upper surface of the frame, a plurality of loop rails, a cowl panel, a back panel, and a package tray. Assembling of the vehicle body components is performed in a main buck) process (refers to a vehicle body build-up process in the art).

In the main buck process, after a back panel is laminated with a floor panel through a vehicle body assembling system, and the both side panels, the loop panel, the loop rail, the cowl panel, and the package tray are welded so that the vehicle body components are assembled.

The vehicle body assembling system regulates the side panel by a side hanger and a side gate to set the side panel to the floor panel, sets the loop panel, a loop rail, a cowl panel, and a package tray to the side panel, and welds a laminating part thereof through a welding robot.

Meanwhile, in the above vehicle body assembly process, after the loop panel is laminated with the side panel through spot welding, a resin loop molding is attached to a laminating region between the side panel and the loop panel.

However, in the related art, since the loop molding is attached to a laminating region between the side panel and the loop panel, an outer appearance is not aesthetical, and the mounting of the loop molding may increase a material cost and a manpower cost.

The above information disclosed in this Background section is only for enhancement of understanding of the background of the disclosure and therefore it may contain information that does not form the prior art that is already known in this country to a person of ordinary skill in the art.

SUMMARY

The present disclosure has been made in an effort to provide a post-process tool having advantages of ensuring quality of a brazing laminating region in a simple configuration in a loop laser brazing system for laminating a laminating region between a side panel and the loop panel.

An exemplary embodiment in the present disclosure provides a post-process tool including a fixing bracket mounted in at least one robot; and a grinding assembly being moved in a longitudinal direction of a vehicle body, and grinding a lamination region.

Further, in the post-process tool according to an exemplary embodiment in the present disclosure, the grinding assembly may include a grinding bracket mounted at the one side of the fixing bracket, a grinding motor reciprocatably installed in the grinding bracket and configured to move in upward and downward directions, and a grinding wheel coupled with a drive shaft of the grinding motor.

Further, in the post-process tool according to an exemplary embodiment in the present disclosure, the grinding assembly may include: a moving plate connected with the drive shaft of the grinding motor a bushing, and being reciprocatably installed in the grinding bracket and configured to move in upward and downward directions; and a wheel cover fixed to the grinding bracket, and covering the grinding wheel.

Further, in the post-process tool according to an exemplary embodiment in the present disclosure, a pair of rail blocks may be installed in upward and downward directions in the grinding bracket.

Further, in the post-process tool according to an exemplary embodiment in the present disclosure, the moving plate may include a sliding block slidably coupled with the rail blocks.

Further, in the post-process tool according to an exemplary embodiment in the present disclosure, the moving plate may be disposed between the grinding bracket and a wheel cover.

Further, in the post-process tool according to an exemplary embodiment in the present disclosure, a guide groove for guiding the bushing in upward and downward directions may be formed in the grinding bracket.

Further, in the post-process tool according to an exemplary embodiment in the present disclosure, the wheel cover may include an inlet sucking a grinding dust scattered by the grinding wheel.

Further, in the post-process tool according to an exemplary embodiment in the present disclosure, the wheel cover may include an air blower removing foreign materials of the laminated regon.

Further, in the post-process tool according to an exemplary embodiment in the present disclosure, the grinding assembly may include, a pressure control cylinder installed in the grinding bracket and connected with the moving plate, and controlling grinding pressure of the grinding wheel as air pressure; and a stopper cylinder installed in the grinding bracket and selectively limiting motion of the moving plate.

Further, in the post-process tool according to an exemplary embodiment in the present disclosure, the fixing bracket may include a proportional valve pressure controller controlling air pressure provided to the pressure control cylinder, to compensate a grinding position of the grinding wheel in upward and downward directions, and to compensate the grinding pressure of the grinding wheel.

Further, in the post-process tool according to an exemplary embodiment in the present disclosure, the proportional valve pressure controller may control air pressure of the pressure control cylinder under control of a controller.

Further, in the post-process tool according to an exemplary embodiment in the present disclosure, the pressure control cylinder may control the grinding pressure of the grinding wheel by a grinding position of the grinding wheel and a weight of the grinding motor to a preset pressure according to air pressure provided through the proportional valve pressure controller.

Further, in the post-process tool according to an exemplary embodiment in the present disclosure, the grinding bracket may include a laser displacement sensor measuring a vertical moving displacement of the moving plate to output a corresponding measurement value to a controller.

Further, in the post-process tool according to an exemplary embodiment in the present disclosure, the controller may calculate an abrasion amount of the grinding wheel based on the measurement value from the laser displacement sensor, and may control rotation speed of the grinding motor based on the abrasion amount of the grinding wheel.

Further, in the post-process tool according to an exemplary embodiment in the present disclosure, a dog plate may be vertically installed in the moving plate.

Further, in the post-process tool according to an exemplary embodiment in the present disclosure, a limit switch confirming abrasion presence of the grinding wheel may be installed in the grinding bracket.

Further, in the post-process tool according to an exemplary embodiment in the present disclosure, the limit switch outputs a switching signal to a controller by the dog plate.

Further, in the post-process tool according to an exemplary embodiment in the present disclosure, the stopper cylinder may include an operation rod which advances and backs up in the moving plate side through the grinding bracket.

Further, in the post-process tool according to an exemplary embodiment in the present disclosure, a friction pad may be installed in the moving plate corresponding to a front end of the operation rod.

Moreover, another embodiment in the present disclosure provides a post-process tool including a fixing bracket mounted in at least one robot, a bead inspector installed in another side of the fixing bracket, and inspecting a lamination region by the grinding assembly while being moved in a longitudinal direction of the vehicle body by the robot; and a marker installed in the bead inspector and spraying a marking liquid to a failure part side of the lamination region detected by the bead inspector.

Further, in the post-process tool according to an exemplary embodiment in the present disclosure, the bead inspector may measure a position of the vehicle body based on a front glass mounting hole and a rear glass mounting hole of the vehicle body to output the measured position to a controller before grinding the lamination region through the grinding assembly.

Further, in the post-process tool according to an exemplary embodiment in the present disclosure, the controller may calculate a grinding position compensation value of the grinding assembly based on the measured position of the vehicle body from the bead inspector to reflect the calculated grinding position compensation value on a moving path of the robot.

Further, in the post-process tool according to an exemplary embodiment in the present disclosure, the bead inspector may include: a mounting bracket installed in another side of the fixing bracket; a line laser irradiator installed in the mounting bracket and configured to irradiate line laser in a direction crossing a side panel and a loop panel of the vehicle body while being interposed the laminated region therebetween; and a vision camera configured to vision-capture the laminated region to control corresponding vision data to a controller.

Further, in the post-process tool according to an exemplary embodiment in the present disclosure, the bead inspector may include: a first illumination part having a ring shape fixed to the mounting bracket in a lower side of the vision camera and configured to irradiate illumination light to the laminated region; and second illumination parts having a bar shape fixed to both sides of the mounting bracket in a longitudinal direction of the vehicle body in a lower side of the first illumination part, respectively, while being interposed the first illumination part therebetween and configured to irradiate the illumination light to a peripheral portion of the grinded laminated region.

Further, in the post-process tool according to an exemplary embodiment in the present disclosure, the bead inspector may include: air jet parts installed in both sides of a bottom end of the mounting bracket in a direction crossing a side panel and a loop panel, respectively, while being interposed grinded laminated region, and configured to spray air in a longitudinal direction of the vehicle body and to form an air curtain corresponding to the vision camera, the first illumination part and, and the second illumination part.

Further, in the post-process tool according to an exemplary embodiment in the present disclosure, the bead inspector may include an air blower installed in one side of the mounting bracket and configured to spray air to grinded laminated region.

Further, in the post-process tool according to an exemplary embodiment in the present disclosure, the line laser irradiator may be inclined with respect to the mounting bracket in a downward direction, and may irradiate liner laser to a lower side of the vision camera.

Further, in the post-process tool according to an exemplary embodiment in the present disclosure, the controller may compare vision data of a surface and the line laser of the grinded brazing bead provided from the vision camera with a preset reference value to detect short, a pore, displacement, depression, and height failure of grinded laminated region.

Further, in the post-process tool according to an exemplary embodiment in the present disclosure, the vision camera may measure a position of the vehicle body based on a front glass mounting hole and a rear glass mounting hole of the vehicle body to output the measured position to a controller before grinding the lamination region through the grinding assembly.

Further, in the post-process tool according to an exemplary embodiment in the present disclosure, the controller may compare vision data of the front glass mounting hole and the rear glass mounting hole with a preset reference value and may calculate a grinding position compensation value of the grinding assembly in a longitudinal direction and a width direction of the vehicle body to reflect the calculated grinding position compensation value on a moving path of the robot.

Further, in the post-process tool according to an exemplary embodiment in the present disclosure, the marker may include a marking body installed in the bead inspector, and configured to spray a marking liquid to a loop panel corresponding to a failure part of laminated region.

Further, in the post-process tool according to an exemplary embodiment in the present disclosure, the marker may include a marking body including an air inlet installed in another side of the mounting bracket and configured to spray air and a nozzle part configured to spray a marking liquid as air pressure.

Further, in the post-process tool according to an exemplary embodiment in the present disclosure, the marking body may lean to a loop panel side based on the laminated region and may be installed in another side of the mounting bracket.

In addition, yet another embodiment in the present disclosure provides post-process tool including: a fixing bracket mounted in at least one robot; a grinding assembly installed at one side of the fixing bracket, being moved in a longitudinal direction of the vehicle body, and configured to grind a laminating region; a bead inspector installed in another side of the fixing bracket, and configured to inspect a laminated region grinded by the grinding assembly while being moved in a longitudinal direction of the vehicle body by the robot; and a marker installed in the bead inspector and configured to spray a marking liquid to a failure part side of the laminated region detected by the bead inspector.

Further, in the post-process tool according to an exemplary embodiment in the present disclosure, the post-process tool may further include a brushing assembly installed in another side of the fixing bracket, and configured to brush the grinded laminated region by the grinded assembly while being moved in a longitudinal direction of the vehicle body by the robot.

Further, in the post-process tool according to an exemplary embodiment in the present disclosure, the brushing assembly may include: a brush bracket mounted in another side of the fixing bracket; a brush motor installed in the brush bracket; a brush coupled with the brush motor; a brush cover mounted in the brush bracket and configured to cover the brush.

Further, in the post-process tool according to an exemplary embodiment in the present disclosure, the brush cover may include an inlet configured to suck a brushing dust scattered by the brush.

In addition, an exemplary embodiment in the present disclosure provides post-process tool for post-processing a laminating region between both side panels and a loop panel of a vehicle body, the post-process tool including: i) a fixing bracket mounted in at least one robot; ii) a polishing unit installed in the fixing bracket, and configured to grind a brazing bead of the laser brazing laminating region, and to brush the grinded brazing bead; iii) a bead inspector installed in the fixing bracket, and configured to inspect a brazing bead grinded by the polishing unit; and iv) a marker installed in the bead inspector and configured to spray a marking liquid to a failure part side of the brazing bead detected by the bead inspector.

Further, in the post-process tool according to an exemplary embodiment in the present disclosure, the polishing unit may include a grinding assembly installed in the fixing bracket, and being moved in a longitudinal direction of the vehicle body by the rotor, and configured to grind a brazing bead of the laser brazing laminating region; and a brushing assembly installed in the fixing bracket separately from the grinding assembly, and configured to brush the brazing bead grinded by the grinding assembly while being moved in a longitudinal direction of the vehicle body by the robot.

Exemplary embodiments in the present disclosure may perform grinding of a loop laser brazing bead, quality inspection, making and brushing of a failure part to ensure excellent quality of the loop laser brazing bead.

Further, exemplary embodiments in the present disclosure may simultaneously perform grinding of a loop laser brazing bead, quality inspection, a failure part making and brushing by a single tool to obtain light-weight and simplification of entire equipment and to reduce an initial investment.

Moreover, an exemplary embodiment in the present disclosure may automatically compensate a location of a grinding assembly according to a height direction, a length direction, and a width direction distribution of a vehicle body through a vertical direction floating structure and a pressing compensate structure of a grinding assembly, and a vision camera of a bead inspector vehicle body to ensure grinding quality of a brazing bead according to a location distribution of the vehicle body.

In addition, an exemplary embodiment in the present disclosure may automatically detect process failure of a loop laser brazing bead through a bead inspector. Visual confirmation of a work is easy in a repair process by making in a loop panel of a failure part, and quality record management of the loop laser brazing bead is possible.

BRIEF DESCRIPTION OF THE DRAWINGS

In the following detailed description, only certain exemplary embodiments in the present disclosure have been shown and described, simply by way of illustration.

DETAILED DESCRIPTION OF THE EMBODIMENTS

Figure 1:
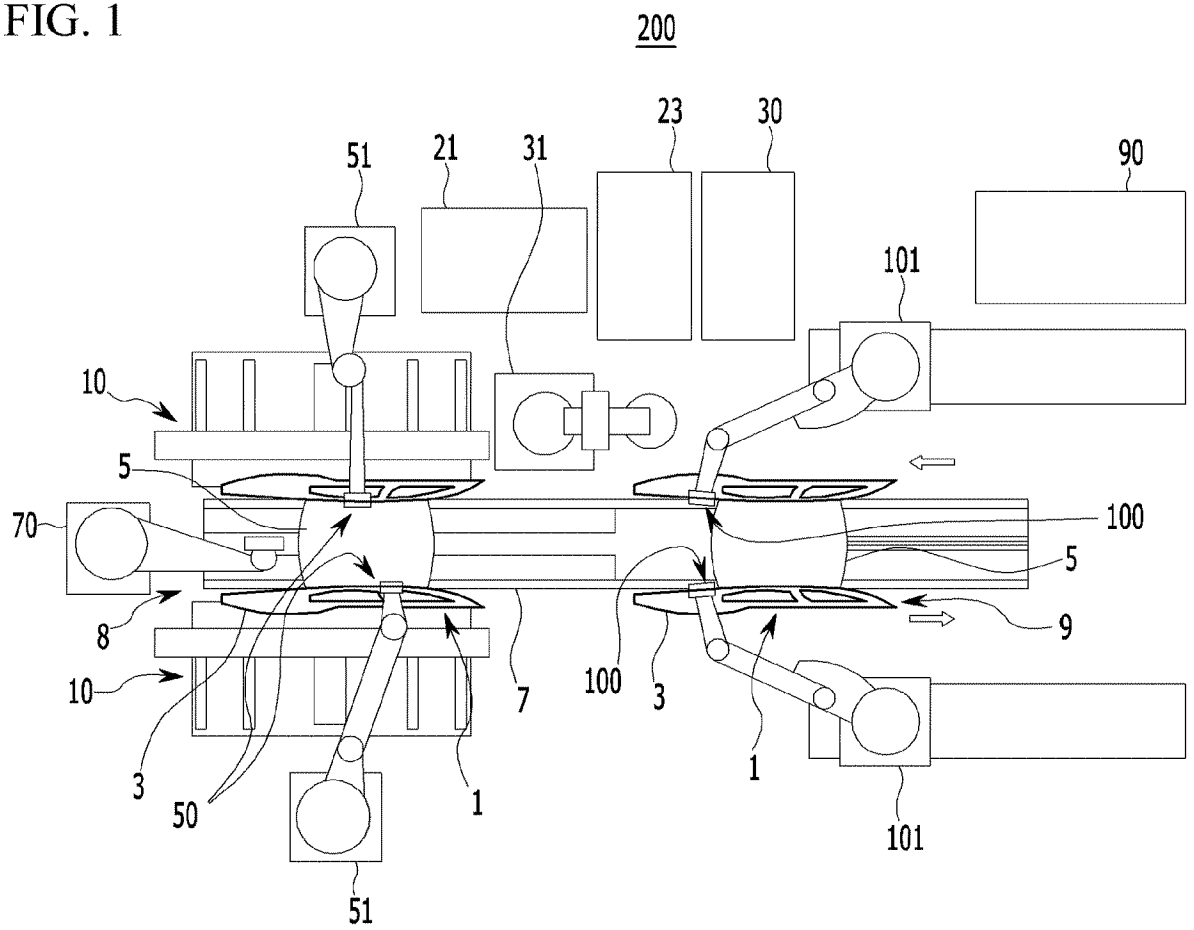
FIG. 1 is a block diagram schematically illustrating a loop laser brazing system to which a post-process tool is applied according to an exemplary embodiment in the present disclosure.

Hereinafter, the present disclosure will be described more fully hereinafter with reference to the accompanying drawings, in which exemplary embodiments of the disclosure are shown. As those skilled in the art would realize, the described embodiments may be modified in various different ways, all without departing from the spirit or scope of the present disclosure.

For the purpose of clearly describing an exemplary embodiment in the present disclosure, parts which are not related to the description are omitted. The same reference numbers are used throughout the specification to refer to the same or like parts.

Further, the size and thickness of each configuration shown in the drawings are optionally illustrated for better understanding and ease of description, the present disclosure is not limited to shown drawings, the thickness is exaggerated for clarity of a plurality of parts and regions.

The terms "first" and "second" can be used to refer to various components, but the components may not be limited to the above terms. The present disclosure is not limited to the order.

Throughout this specification, in addition, unless explicitly described to the contrary, the word "comprise" and variations such as "comprises" or "comprising", will be understood to imply the inclusion of stated elements but not the exclusion of any other elements.

Further, the term " . . . unit", " . . . means", " . . . part", and " . . . member" described in the specification refers to a unit of a general configuration processing at least one function or operations.

FIG. 1 is a block diagram schematically illustrating a loop laser brazing system to which a post-process tool is applied according to an exemplary embodiment in the present disclosure.

Referring to FIG. 1, the post-process tool 100 according to an exemplary embodiment in the present disclosure is applicable to a main buck process of a vehicle body assembling line for regulating and welding a main buck assembling component by a jig and assembling a vehicle body.

Further, the post-process tool 100 is applicable to a process of laminating a loop panel 5 with both side panels 3 based on a vehicle body 1 including the both side panels 3 in the main buck process of a vehicle body assembling line.

In addition, the post-process tool 100 according to an exemplary embodiment in the present disclosure is applicable to a loop laser brazing system 200 for laminating a matching region between the both side panels 3 and the loop panel 5 of the vehicle body 1 in a laser brazing scheme.

In this case, the vehicle body 1 may be configured by assembling the both side panels 3 at a predetermined vehicle body structure. For example, the vehicle body 1 may be configured by assembling the both side panels 3 at both sides of a floor panel (not shown in drawings). The vehicle body 1 may be moved along a transfer line 7 through a truck (not shown in the drawings).

In the art, a width direction of the vehicle body 1 refers to an L direction, a length direction or a transfer direction of the vehicle body 1 refers to a T direction, and a height direction of the vehicle body 1 refers to an H direction. In an exemplary embodiment in the present disclosure, 3 axis directions are defined as the width direction, the length direction, and the height direction of the vehicle body instead of the above LTH directions.

Meanwhile, the laser brazing system 200 to which the post-process tool 100 is applied may be configured in a predetermined brazing section 8 and a post-process section 9 along a transfer path of the vehicle body 1. The loop laser brazing system 200 may laminate both side panels 3 and the loop panel 5 of the vehicle body 1 in the brazing section 8 in a laser brazing scheme.

Further, the loop laser brazing system 200 may grind and brush a laminating region, for example a laser brazing bead of a brazing laminating region between both side panels 3 and the loop panel 5 in the post-process section 9 through a post-process tool 100, and may automatically inspect quality of the grinded brazing bead.

Meanwhile, the loop laser brazing system 200 includes a side home position jig 10, a loop pressing jig 30, and a brazing assembly 50 which are installed in the brazing section 8.

The side home position jigs 10 regulate and home-position both side panels 3 of the vehicle body 1, and are installed at both sides of a transfer path of the vehicle body 1 in a brazing section 8.

The side home position jig 10 may clamp both side panels 3 of the vehicle body 1 and home-position the both side panels 3 in a predetermined location based on a vehicle body 1 of a predetermined vehicle type transferred to the brazing section 8 through a transfer path of a transfer line.

The loop pressing jig 30 home-positions a loop panel 5 loaded on both side panels 3 of the vehicle body 1, and presses the loop panel 5 through a handling robot 31. The loop pressing jig 30 is removably installed in the handling robot 31, and may be docked in the above side home position jig 10.

In this case, the loop panel 5 may be unloaded from the loop alignment jig 21 through a loop loading jig 23 while being aligned in the loop alignment jig 21, and may be loaded on the both side panels 3 of the vehicle body 1.

The loop alignment jig 21 aligns the loop panel 5 in a predetermined position, and is installed between the brazing section 8 and a post-process section 9. The loop loading jig 23 is removably installed in the above handling robot 31.

The loop alignment jig 21 includes a reference pin configured to hold a reference position of the loop panel 5 and retainers configured to support an edge part of the loop panel 5. The loop loading jig 23 includes a reference pin configured to hold a reference position of the loop panel 5 and clampers configured to regulate an edge part of the loop panel 5.

Further, the handling robot 31 may tool-change the loop loading jig 23, the loop pressing jig 30, and a spot welding gun (not shown in drawings) through a tool changer.

Figure 2:
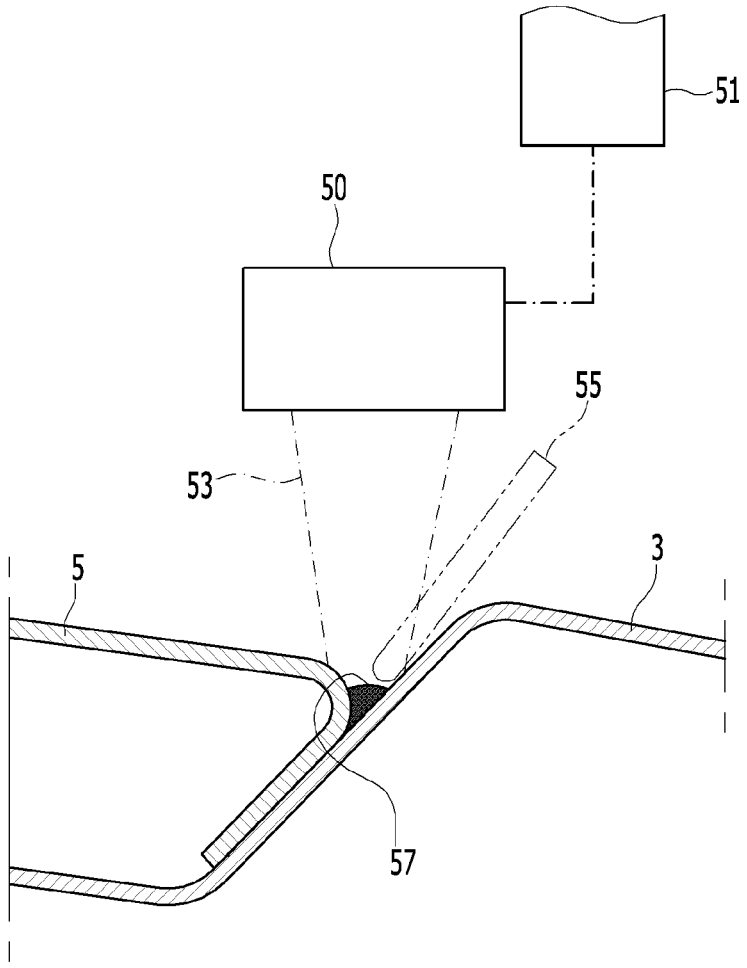
FIG. 2 is a view schematically illustrating a laser brazing principle in a loop laser brazing system to which a post-process tool is applied according to an exemplary embodiment in the present disclosure.

As shown in FIGS. 1 and 2, the brazing assembly 50 brazing-laminates a matching region between the both side panels 3 and the loop panel 5 which are pressed and adhered to each other by a loop pressing jig 30 in the brazing section 8 by using laser as a heat source.

The brazing assembly 50 is mounted at a pair of brazing robots 51 in a side home position jig 10 in the side home position jig 10 side of the brazing section 8. The brazing robots 51 are installed in the home position jig 10 side while being interposed a transfer line of the vehicle body 1 therebetween.

In this case, the brazing assembly 50 may melt a filler material by using laser as a heat source, and may brazing-laminate a matching region between the both side panels 3 and the loop panel 5.

For example, the brazing assembly 50 may melt a filler wire 55 being the filler material and form a brazing bead 57 by irradiating a continuous wave Nd:YAG laser beam 53 oscillated from a laser oscillator on a matching region between the both side panels 3 and the loop panel 5 to brazing-laminate the matching region between the both side panels 3 and the loop panel 5.

Reference numeral 70, which is not described in FIG. 1, represents a welding robot on which a spot welding gun for spot welding the loop panel 5 and a front/rear loop rail part is mounted, and the welding robot 70 is included in the brazing section 8.

Meanwhile, as shown in FIG. 1, the brazing post-process tool 100 according to an exemplary embodiment in the present disclosure is configured in a post-process section 9 of the loop laser brazing system 200.

The post-process tool 100 for the loop laser brazing system according to an exemplary embodiment in the present disclosure may grind a brazing bead 57 (see FIG. 2) at a laminating region between the both side panels 3 and the loop panel 5 which are laser-brazing-laminated by the brazing assembly 50.

That is, the post-process tool 100 may grind the brazing bead 57 in a state that laser brazing lamination between the both side panels 3 and the loop panel 5 by the brazing assembly 50 in a brazing section 8 of a body transfer path is completed, and the vehicle body 1 is transferred to the post-process section 9 along a body transfer path.

Moreover, the post-process tool 100 may automatically inspect quality of the grinded brazing bead 57, and detect a process failure part of the brazing bead 57. Furthermore, the post-process tool 100 may make a surface of the brazing bead 57 smooth and may remove an oxide film and soot included in the brazing bead 57 by brushing the grinding the brazing bead 57.

In this case, the post-process tool 100 is configured in a pair of tool robots 101 (hereinafter, referred to as "robot" for convenience) in a post-process section 9 of a body transfer path. The tool robot 101 is installed at both sides of a transfer path of the vehicle body 1 while being interposed the transfer path therebetween. The post-process tool 100 may be moved along a predetermined teaching path by the tool robot 101, and may be rotated by an arm of the tool robot 101.

Figure 3:
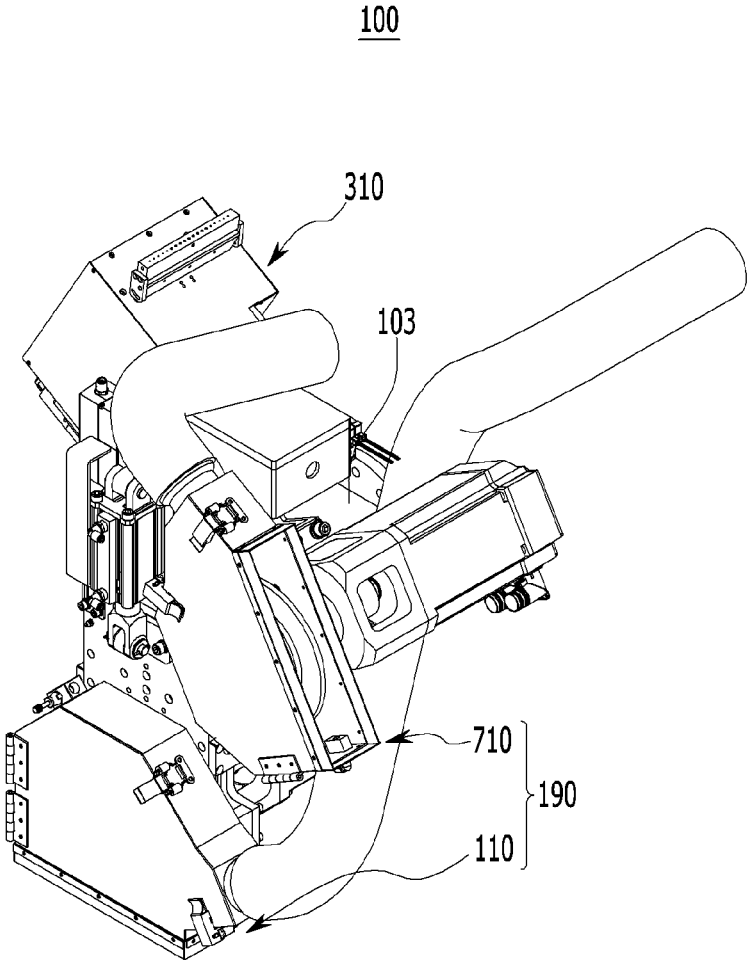
FIG. 3 is a perspective view illustrating a post-process for a loop laser brazing system according to an exemplary embodiment in the present disclosure.
Figure 4:
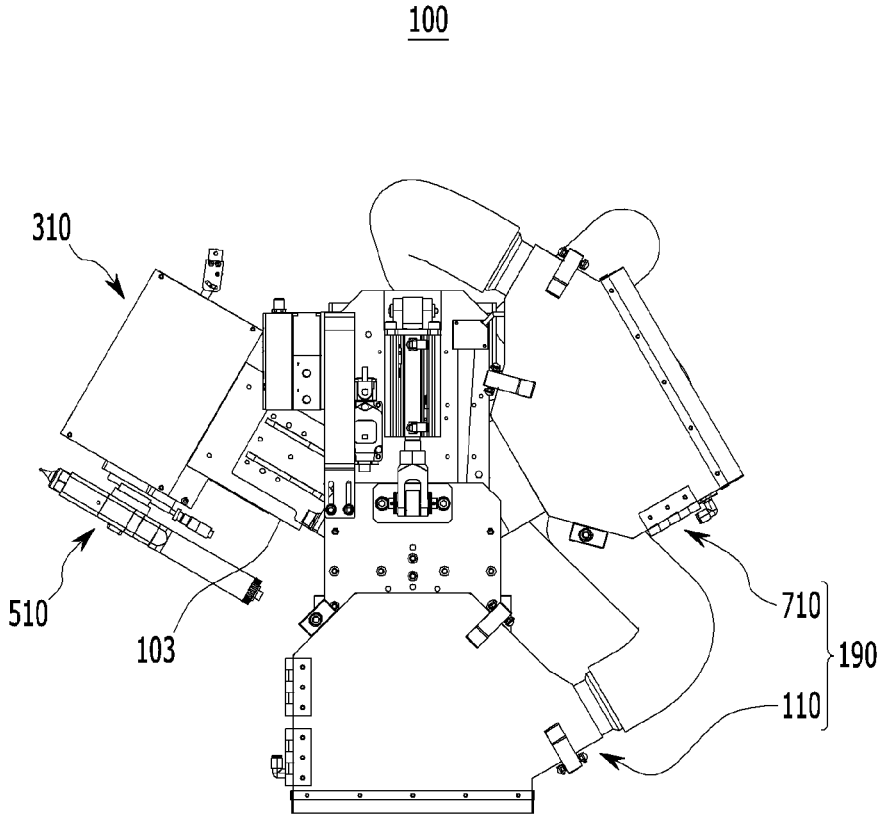
FIG. 4 is a front view illustrating a post-process for a loop laser brazing system according to an exemplary embodiment in the present disclosure.

FIG. 3 is a perspective view illustrating a post-process for a loop laser brazing system according to an exemplary embodiment in the present disclosure, and FIG. 4 is a front view illustrating a post-process for a loop laser brazing system according to an exemplary embodiment in the present disclosure.

Referring to FIGS. 3 and 4, the post-process tool 100 for the loop laser brazing system according to an exemplary embodiment in the present disclosure may include a fixing bracket 103, a grinding assembly 110, a bead inspector 310, a marker 510, and a brushing assembly 710.

The fixing bracket 103 is mounted in an arm front end of the robot 101 of FIG. 1, and may be tool-changed in the arm front end thereof, may be rotated by the arm thereof, and may be moved along a laser brazing lamination region between the both side panels 3 of FIG. 1 and the loop panel 5 of FIG. 1 by the robot 101.

One or more fixing brackets 103 may be mounted at an arm front end of the robot 101, and various constituent elements to be described later may be installed at the fixing bracket 103. The fixing bracket 103 may include various attached elements such as a bar, a rod, a plate, a rib, a block, a partition, a rail, a collar for supporting constituent elements.

However, the various attached elements are configured to install constituent elements at the fixing bracket 103. In an exemplary embodiment in the present disclosure, the attached elements refer to the fixing bracket 103 except for an exceptional case.

In an exemplary embodiment in the present disclosure, the grinding assembly 110 is moved in a longitudinal direction of the vehicle body 1 (see FIG. 1) by the robot 101, and grinds a brazing bead 57 (see FIG. 2) of a laser brazing laminating region between the both side panels 3 and the loop panel 5.

The grinding assembly 110 may grind the brazing bead 57 in a state that laser brazing lamination between the both side panels 3 and the loop panel 5 by the brazing assembly 50 of FIG. 1 in a brazing section 8 of FIG. 1 is completed, and the vehicle body 1 is transferred to the post-process section 9 along a body transfer path. In this case, the grinding assembly 110 is moved along a predetermined teaching path by the robot 101, and may grind the brazing bead 57.

The grinding assembly 110 may configure a polishing unit 190 together with a brushing assembly 710 configured to brush a grinded brazing bead 57 to be described in detail later.

Figure 5:
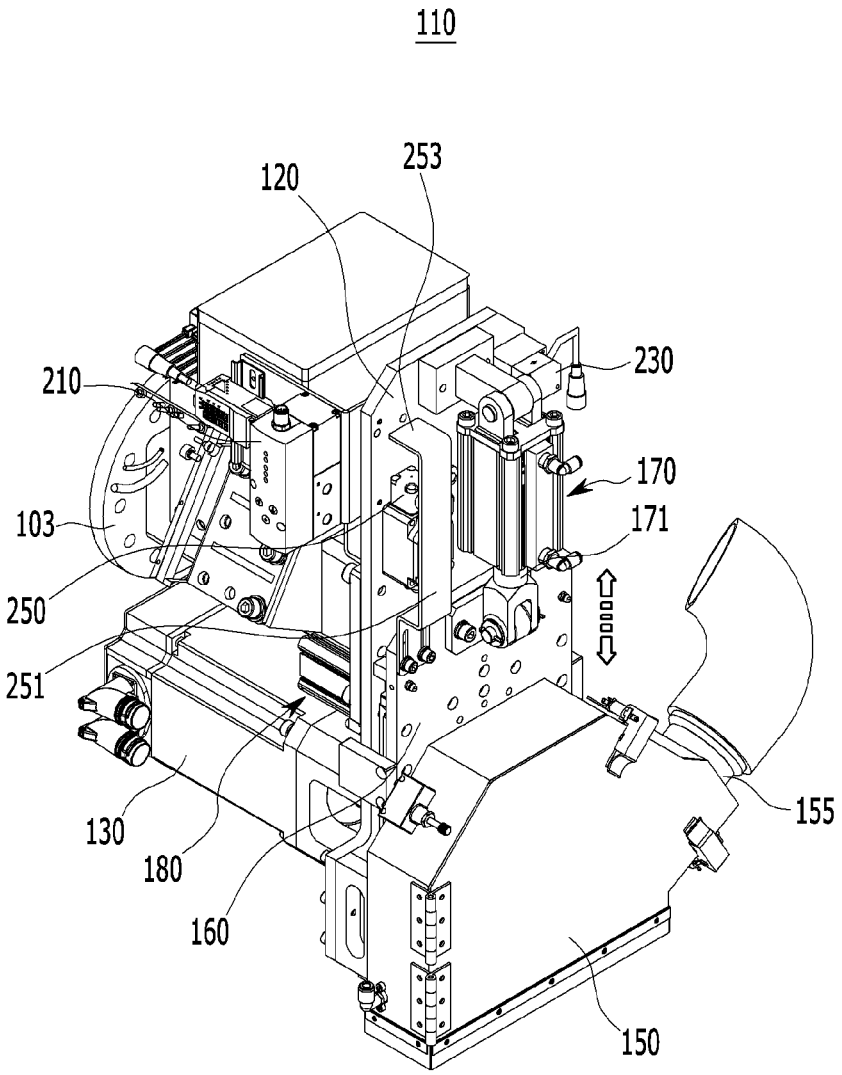
FIG. 5 and FIG. 6 are perspective views illustrating a grinding assembly which is applied to a post-process tool for a roof laser brazing system according to an exemplary embodiment in the present disclosure.
Figure 6:
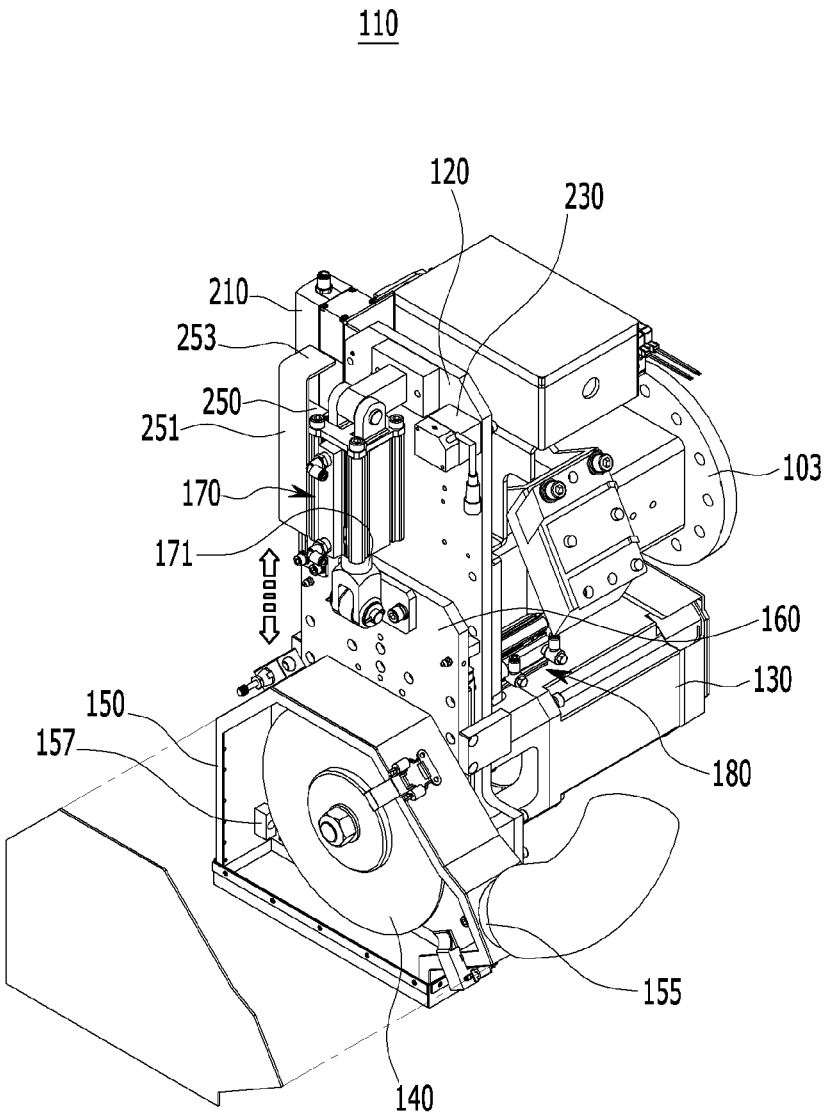
Figure 7:
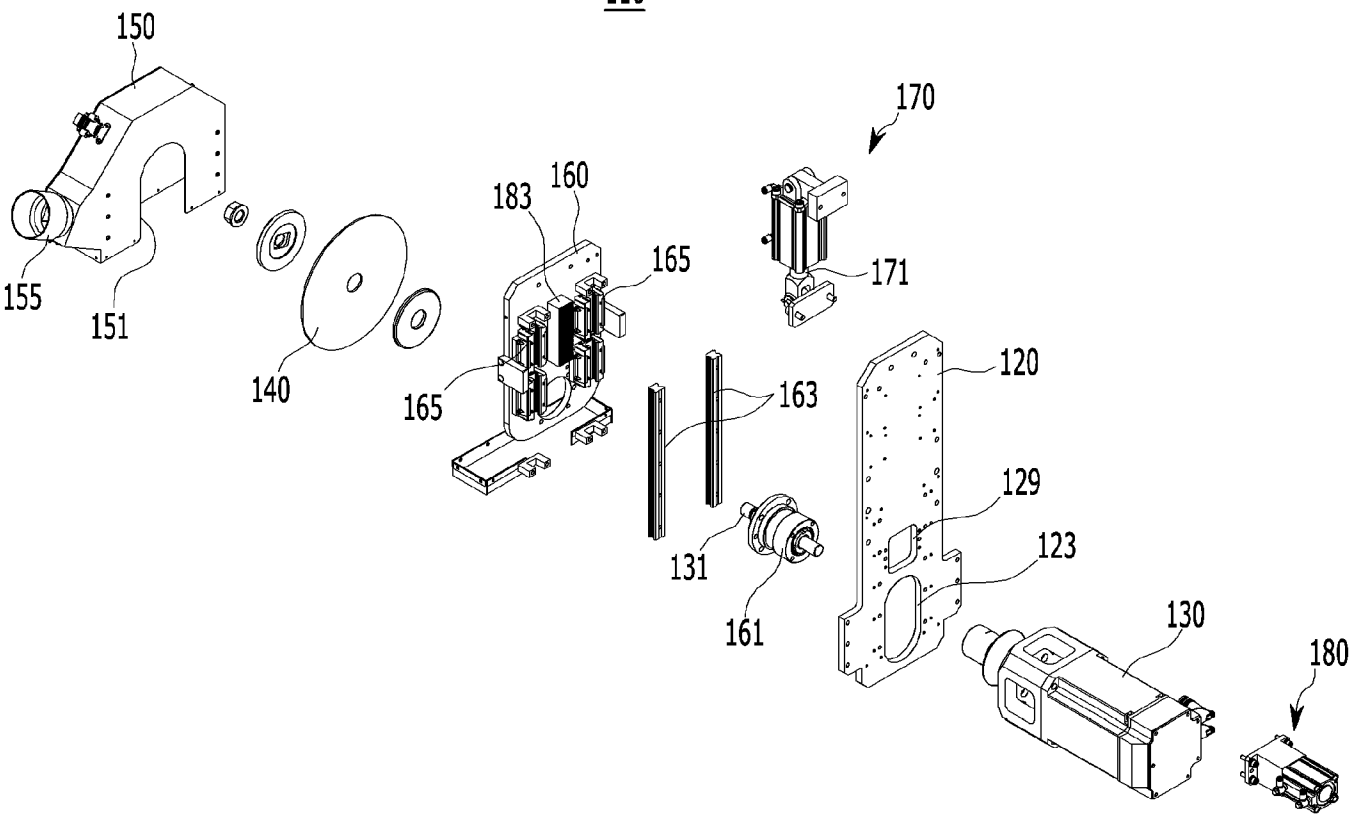
FIG. 7 is an exploded perspective view illustrating a grinding assembly which is applied to a post-process tool for a roof laser brazing system according to an exemplary embodiment in the present disclosure.
Figure 8:
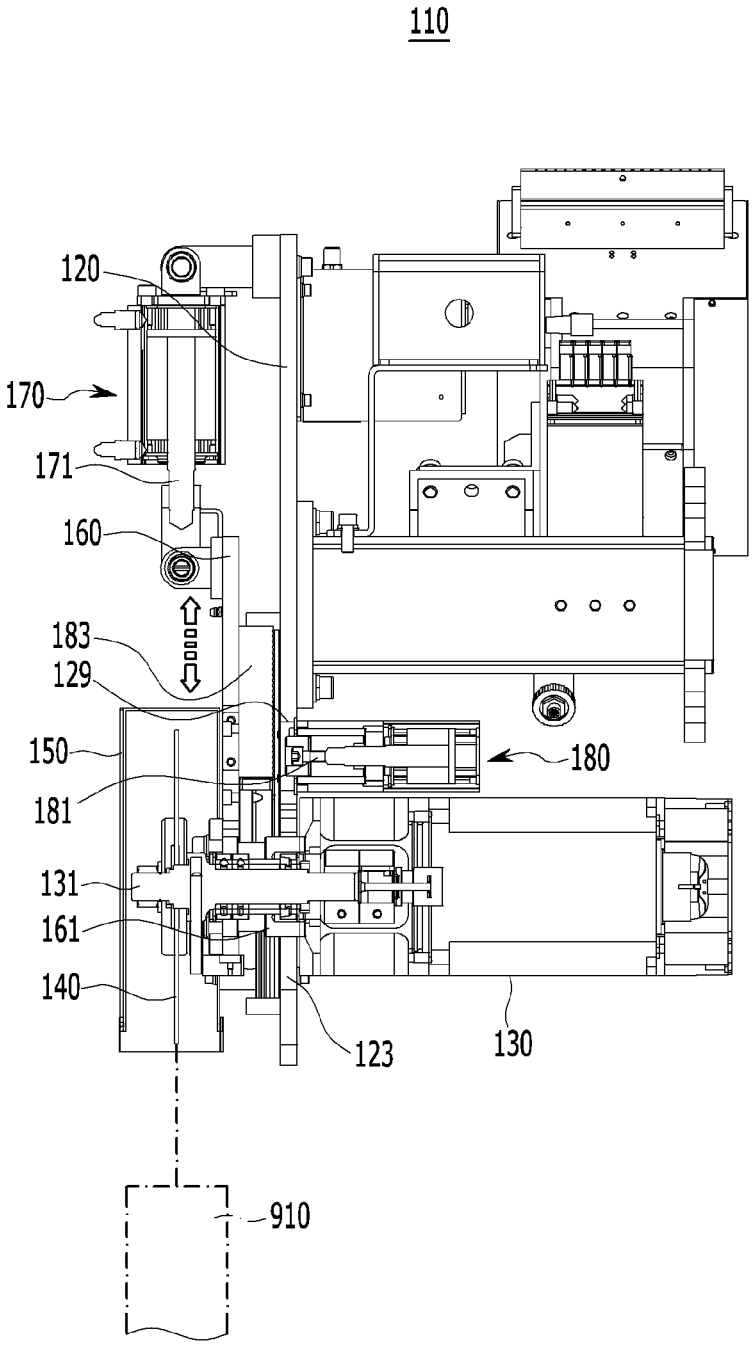
FIG. 8 is a coupling sectional view illustrating a grinding assembly which is applied to a post-process tool for a roof laser brazing system according to an exemplary embodiment in the present disclosure.

FIGS. 5 and 6 are perspective views illustrating a grinding assembly which is applied to a post-process tool for a roof laser brazing system according to an exemplary embodiment in the present disclosure, FIG. 7 is an exploded perspective view of FIGS. 5 and 6, and FIG. 8 is a coupling sectional view of FIG. 7.

Referring to FIG. 5 to FIG. 8 together with FIG. 1 to FIG. 4, the grinding assembly 110 according to an exemplary embodiment in the present disclosure includes a grinding bracket 120, a grinding motor 130, a grinding wheel 140, a wheel cover 150, a moving plate 160, a pressure control cylinder 170, and a stopper cylinder 180.

The grinding bracket 120 mounts constituent elements to be described later, and is fixed to one side of the fixing racket 103 as described above. The grinding bracket 120 may be rotated together with the fixing bracket 103 by the robot 101.

The grinding motor 130 rotates the grinding wheel 140 to be described later. The grinding motor 130 is movably installed in upward and downward directions from the grinding bracket 120 based on the drawing. For example, the grinding motor 130 may include a servo motor which may serve to control the rotation speed.

The grinding wheel 140 grinds a brazing bead 57 at a lamination region between the both side panels 3 and the loop panel 5 which are laser brazing laminated. The grinding wheel 140 has a disk shape and may be coupled and rotated with a drive shaft 131 of the grinding motor 130.

The wheel cover 150 covers the grinding wheel 140, and collects a grinding dust scattered when the brazing bead 57 at a lamination region between the both side panels 3 and the loop panel 5 is grinded through the grinding wheel 140 without hindering the vertical direction of the grinding motor 130.

The wheel cover 150 encloses the whole part of the grinding wheel 140 coupled with a drive shaft 131 of the grinding motor 130, serves as a housing with an open bottom end, and is fixed to the grinding bracket 120. The wheel cover 150 is slippably moved in a longitudinal direction of the vehicle body 1 by a robot 101 in a state that a bottom end of the wheel cover 150 makes contact with the side panel 3 and the loop panel 5.

In this case, the grinding wheel 140 may be rotated by the grinding motor 130 in an inner side of the wheel cover 150, and may grind the brazing bead 57 through a lower open end of the wheel cover 150.

Further, a first guide groove 151 for guiding a vertical motion of the grinding motor 130 is formed in the wheel cover 150 not to hinder the vertical motion of the grinding motor 130. The first guide groove 151 is formed in an upward direction from a lower open end in one side of a wheel cover 150 fixed to the grinding bracket 120.

Moreover, the wheel cover 150 is provided therein with an inlet for sucking a grinding dust scattered when the grinding wheel 140 grinds the brazing bead 57 at a lamination region between the both side panels 3 and the loop panel 5.

The inlet 155 sucks the grinding dust scattered inside the wheel cover 150 to exhaust the sucked grinding dust to an outside of the wheel cover 150. For example, the inlet 155 may be connected to a vacuum pump (not shown in the drawing) through a dust exhaust line (not shown in the drawing).

In addition, a first air blower 157 for removing foreign materials included in the brazing bead 57 by air pressure is installed in the wheel cover 150. The first air blower 157 is installed at an inner surface of the wheel cover 150 corresponding to the grinding wheel 140.

Moreover, the first air blower 157 serves to scatter the grinding dust generated when grinding the brazing bead 57 through the grinding wheel 140 to an inner side of the wheel cover 150 by air pressure.

The moving plate 160 supports the grinding motor 130 with respect to the grinding bracket 120 and guides the vertical motion of the grinding motor 130, and is disposed between the grinding bracket 120 and the wheel cover 150.

The moving plate 160 is connected with a drive shaft 131 of the grinding motor 130 through a bushing 161, and is reciprocatably installed in upward and downward directions in the grinding bracket 120.

The bushing 161 is installed on the drive shaft 131 of the grinding motor 130 and rotatably supports the drive shaft 131 of the grinding motor 130, and serves as a rotating support means having a cylindrical shape.

As described above, for the vertical motion of the moving plate 160, a pair of rail blocks 163 is installed at one surface of the grinding bracket 120 corresponding to the moving plate 160. In addition, a pair of sliding blocks 165 slidably coupled with the rail block 163 is installed at one surface of the moving plate 160 corresponding to the rail block 163.

In this case, since the grinding motor 130 is connected with the moving plate 160 through the bushing 161 on the drive shaft 131, the grinding motor 130 may reciprocate in upward and downward directions from the grinding bracket 120 through the rail block 163 and a sliding block 165.

That is, the grinding motor 130 may be moved in a downward direction by its own weight, and may be moved in an upward direction by an external force. The lowermost moving position and the uppermost moving position of the grinding motor 130 may be determined by a separate stopper, for example, stopper protrusions provided in an upper end and a lower end of the rail block 163.

A second guide groove 123 for guiding the bushing 161 in upward and downward directions so as not to hinder the vertical motion of the grinding motor 130 is formed in the grinding bracket 120.

The second guide groove 123 is longitudinally formed in the upward direction from a bottom end in one surface of the grinding bracket 120 corresponding to the moving plate 160, and may guide the bushing 16 on the drive shaft 131 of the grinding motor 130 in upward and downward directions.

The pressure control cylinder 170 controls a grinding pressure of the grinding wheel 140 (force applied by the grinding wheel 140) operating in a brazing bead 57 of a lamination region between the both side panels 3 and the loop panel 5.

The pressure control cylinder 170 is fixed to the grinding bracket 120, and is connected with the moving plate 160. The pressure control cylinder 170 is fixed on a top end of the grinding bracket 120 through a mounting bracket, and is connected with the moving plate 160 through the pressure control rod 171.

In this case, the pressure control cylinder 170 applies air pressure of 0 to 10 bar to the moving plate 160 through the pressure control rod 171, and may control grinding pressure (e.g., 6 kgf to 8 kgf; applied force) of a grinding wheel 140 with respect to the brazing bead 57 by lifting the moving plate 160 in the upward direction or descending the moving plate 160 in the downward direction together with the grinding motor 130.

Furthermore, an exemplary embodiment in the present disclosure includes a proportional valve pressure controller 210 configured to control air pressure provided to the pressure control cylinder 170, to compensate for the grinding pressure with respect to the brazing bead 57, and to compensate for the grinding position of the grinding wheel 140 in upward and downward directions.

The proportional valve pressure controller 210 may receive a control signal from a controller 90 of FIG. 1 to control air pressure provided to the pressure control cylinder 170.

The proportional valve pressure controller 210 is installed in the fixing bracket 103 as described above, and may apply air pressure of 0 bar to 10 bar range to the pressure control cylinder 170 according to a voltage and a current applied through the controller 90.

In this case, the pressure control cylinder 170 may compensate a grinding position of the grinding wheel 140 according to position distribution of the vehicle body 1 to the grinding position of the grinding wheel 140 according to air pressure provided from the proportional valve pressure controller 210.

Furthermore, the pressure control cylinder 170 may control grinding pressure of the grinding wheel 140 according to the weight of the grinding motor 130 (force applied by the weight of the grinding motor 130; e.g., 30 kgf) to predetermined pressure (e.g., 6 kgf to 8 kgf; applied force) according to air pressure (for example, compensating pressure of 22 kgf to 24 kgf) provided through the proportional valve pressure controller 210.

Meanwhile, a laser displacement sensor 230 for measuring a vertical motion displacement of the moving plate 160 to output a measured value to the controller 90 is installed in the grinding bracket 120.

The laser displacement sensor 230 irradiates laser to an end of the moving plate 160 to receive laser reflected from the end of the moving plate 160, and may measure a moving displacement of the moving plate 160.

The controller 90 may calculate an abrasion amount of the grinding wheel 140 based on the measured value from the laser displacement sensor 230, and may control rotation speed of the grinding motor 130 based on the abrasion amount of the grinding wheel 140.

As described above, a reason why rotation speed of the grinding motor 130 is controlled based on the abrasion amount of the grinding wheel 140 is to maintain line contact speed of a grinding surface according to abrasion of the grinding wheel 140 constant.

Meanwhile, a limit switch 250 for confirming presence of abrasion of the grinding wheel 140 is installed in the grinding bracket 120. Further, a dog plate 251 for switch operation of the limit switch 150 is installed in the moving plate 160. The dog plate 251 is vertically installed in the moving plate 160. A bending part 253 makes contact with the limit switch 250 is formed in the dog plate 251.

When the grinding wheel 140 grinds the brazing bead 57 and is worn, since the bending part 153 of the dog plate 251 makes contact with the limit switch 250 according to moving of the moving plate 160 in a downward direction, the limit switch 250 may output a switching signal to the controller 90 by the dog plate 251.

Accordingly, the controller 90 may analyze the switching signal from the limit switch 250 to display abrasion presence and replacement presence of the grinding wheel 140 through a predetermined display (not shown in the drawing).

In an exemplary embodiment in the present disclosure, the stopper cylinder 180 is fixed to the grinding bracket 120 in order to selectively limit motion of the moving plate 160. The stopper cylinder 180 may limit the downward motion by the weight of the grinding motor 130.

The stopper cylinder 180 includes a stopper operation rod 181 which advances and backs up the moving plate 160 side through the grinding bracket 120. Accordingly, a penetration hole 129 is formed through the stopper operation rod 181 in the grinding bracket 120.

Further, a friction pad 183 is installed at one surface of the moving plate 160 corresponding to a front end of the stopper operation rod 181. The friction pad 183 may adhere to a front end of the stopper operation rod 181 to limit the downward direction of the moving plate 160 due to the weight of the grinding motor 130. For example, the friction pad 183 may be made of Teflon rubber material.

Reference numeral 910, which is not described in FIG. 1, represents a support means configured to compensate for a position of the grinding wheel 140. The support means 910 may be included as a compensation block which is upright from a ground of a worker.

Figure 9:
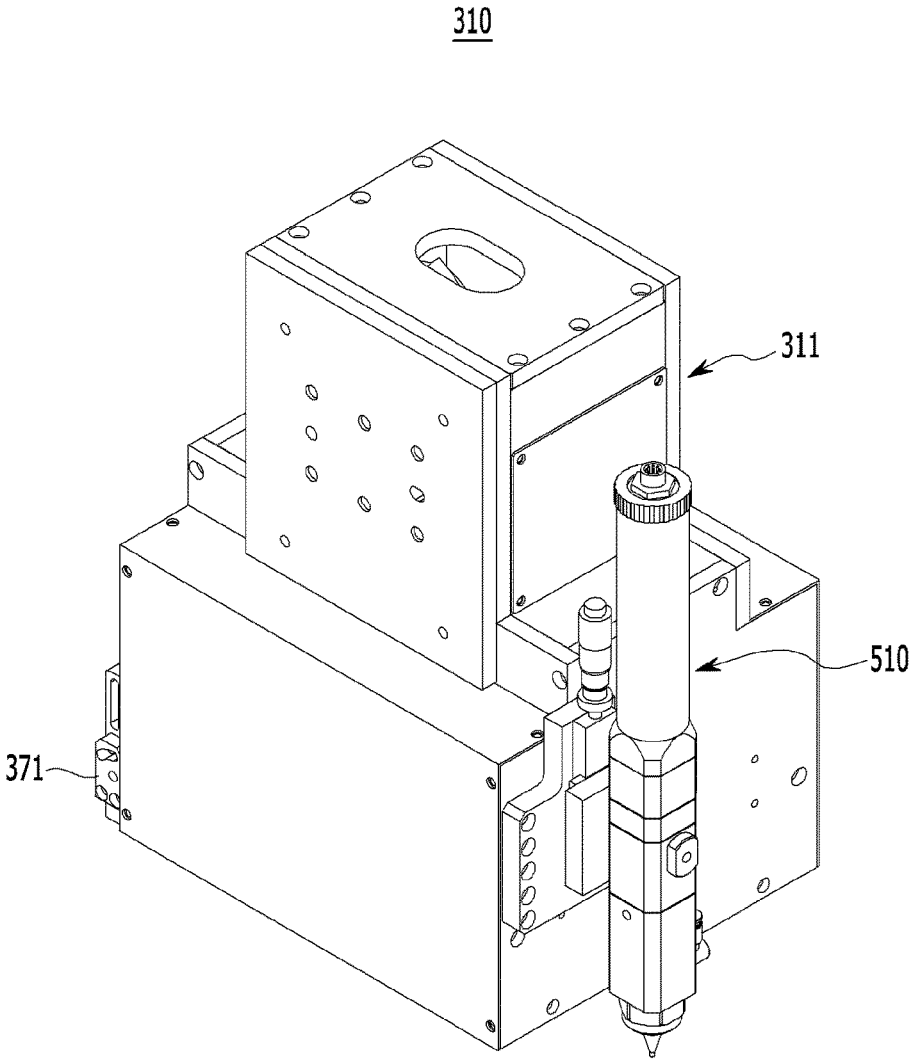
FIG. 9 is a perspective view illustrating a bead inspector which is applied to a post-process tool for a roof laser brazing system according to an exemplary embodiment in the present disclosure.
Figure 10:
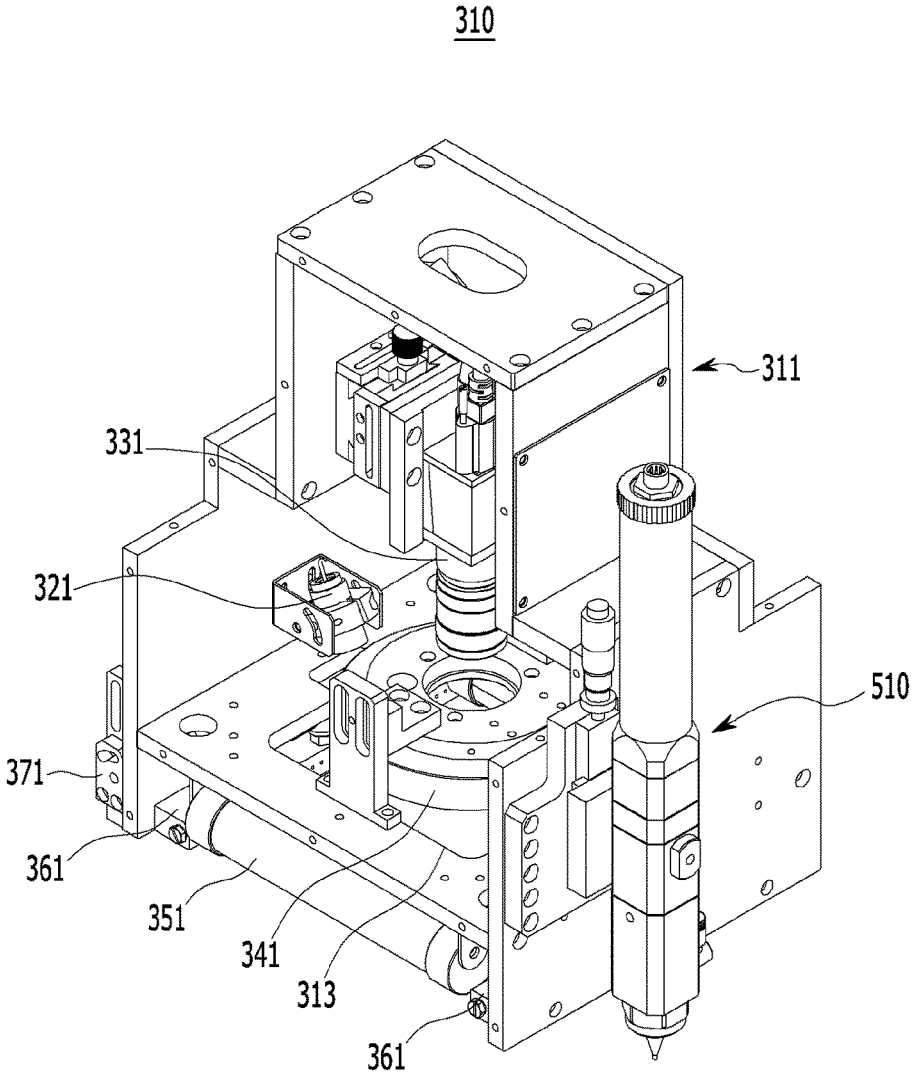
FIG. 10 is a cut-away, perspective view illustrating a bead inspector which is applied to a post-process tool for a roof laser brazing system according to an exemplary embodiment in the present disclosure.
Figure 11:
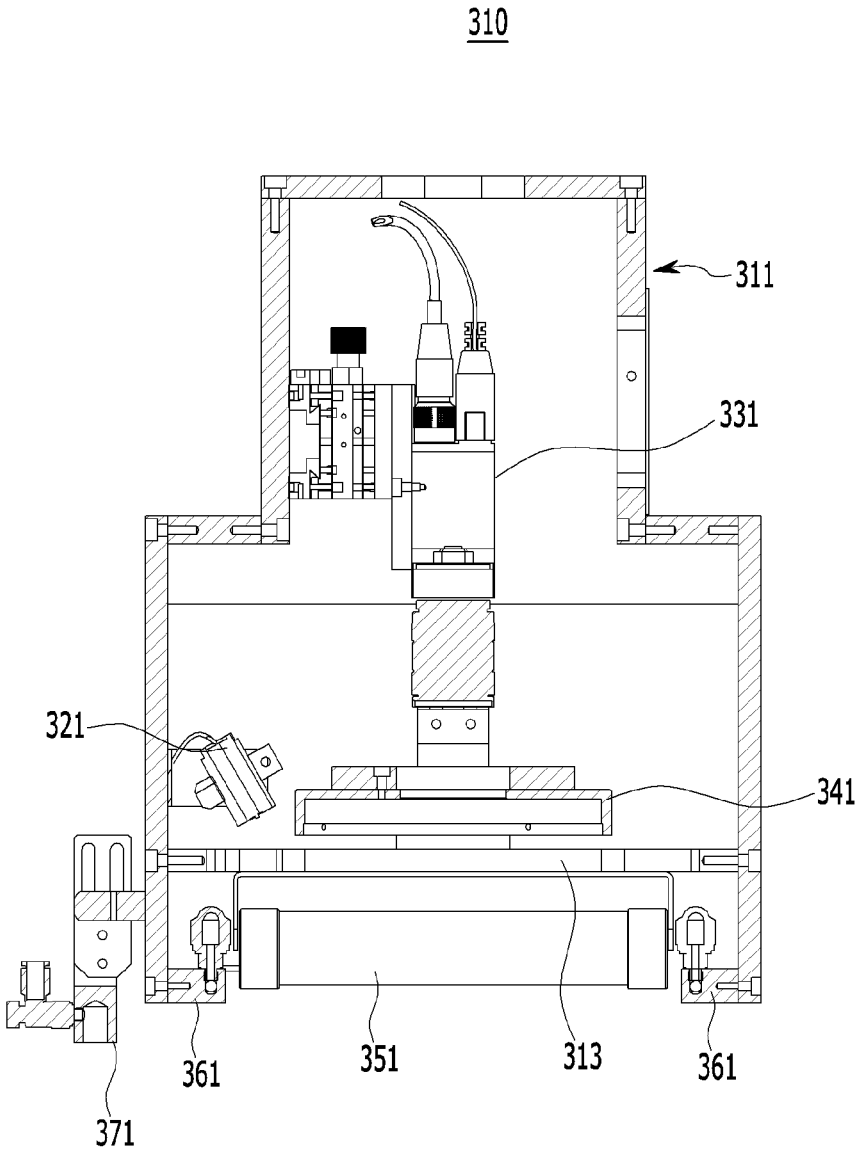
FIG. 11 is a schematic sectional view illustrating a bead inspector which is applied to a post-process tool for a roof laser brazing system according to an exemplary embodiment in the present disclosure.

FIG. 9 is a perspective view illustrating a bead inspector which is applied to a post-process tool for a roof laser brazing system according to an exemplary embodiment in the present disclosure, FIG. 10 is a cut-away, perspective view of FIG. 9, and FIG. 11 is a schematic sectional view illustrating a bead inspector of FIG. 9.

Referring to FIG. 9 to FIG. 11 together with FIG. 1 to FIG. 4, in an exemplary embodiment in the present disclosure, the bead inspector 310 inspects the brazing bead 57 grinded by the grinding assembly 110.

The bead inspector 310 may move the brazing bead 57 grinded by the grinding assembly 110 in a longitudinal direction of the vehicle body by the robot 101, and may automatically detect a failure part of the brazing bead 57. The bead inspector 310 is installed in another side of the fixing bracket 103. The bead inspector 310 includes a mounting bracket 311, a line laser irradiator 321, and a vision camera 331.

The mounting bracket 311 is included as a mounting housing configured to mount constituent elements to be described later, and is fixed to another side of the fixing bracket 103. The mounting bracket 311 may be rotated together with the fixing bracket 103 by a robot 101. An inspection hole 313 for inspecting the brazing bead 57 is formed at a lower center of the mounting bracket 311.

The line laser irradiator 321 measures a height difference between the loop panel 5 and the brazing bead 57, and a height difference between the brazing bead 57 and the side panel 3, and is installed in the mounting bracket 311.

The line laser irradiator 321 irradiates line laser in a direction through the side panel 3 and the loop panel 5 while being interposed the grinded brazing bead 57 therebetween. In this case, the line laser irradiator 321 is inclined with respect to the mounting bracket 311 in a downward direction. The line laser irradiator 321 irradiates line laser to a brazing bead 57 from a lower side of the vision camera 331 to be described later through the inspection hole 313 of the mounting bracket 311.

The vision camera 331 vision-captures a brazing bead 57 region grinded by the grinding assembly 110 to output corresponding vision data to the controller 90, and is installed in the mounting bracket 311. That is, the vision camera 331 vision-captures line laser irradiated to a surface of the brazing bead 57 and the brazing bead 57 region from the line laser irradiator to output vision data to the controller 90. The vision camera 331 is fixed to a mounting bracket 311 in a lower side of the inspection hole 313 of the mounting bracket 311.

The controller 90 may calculate a surface of a brazing bead 57 provided from the vision camera 331 and a width and a height of the brazing bead 57 from the vision data of line laser and may compare the calculation value with a preset reference value to detect whether the brazing bead 57 fails.

For example, the controller 90 may detect a surface of the brazing bead 57 provided from the vision camera 331 and short, a pore, displacement, depression, and height failure of the brazing bead 57 from the vision data of the line laser.

Further, the vision camera 331 may measure a position of the vehicle 1 to output a position measurement value to the controller 90 based on a front glass mounting hole (not shown in the drawing) and a rear glass mounting hole (not shown in the drawing) of the vehicle body 1 before a brazing bead 57 of a laser brazing lamination region is grinded through the grinding assembly 110.

That is, the vision camera 331 may vision-capture the front glass mounting hole and the rear glass mounting hole of the vehicle body 1 to output vision data to the controller 90 before the brazing bead 57 of the laser brazing lamination region is grinded through the grinding assembly 110.

Accordingly, the controller 90 may compare the vision data (position measurement value) of the front glass mounting hole and the rear glass mounting hole with a preset reference value to calculate a grinding position compensation value of the grinding assembly 110 according to longitudinal direction and width direction distribution of the vehicle body 1 and reflect the position compensation value on a moving path of the robot 101.

Meanwhile, the bead inspector 310 according to an exemplary embodiment in the present disclosure may further include a first illumination part 341, a second illumination part 351, an air jet part 361 and a second air blower 371.

The first illumination part 341 irradiates illumination light to the grinded brazing bead 57 side, and provides sufficient light amount to the brazing bead 57. The first illumination part 341 is fixed to the mounting bracket 311. The first illumination part 341 has a ring shape, and is disposed in a lower side of the vision camera 331 in a upper side of the inspection hole 313 of the mounting bracket 311.

The second illumination part 351 irradiates the illumination light to a peripheral portion of the grinded brazing bead 57, and provides a sufficient light amount to the side panel 3 and the loop panel 5 side. The second illumination part 351 has a pair of bar shapes, and is fixed to both sides of the mounting bracket 311 in a longitudinal direction of the vehicle body 1 in a lower side of the first illumination part 341 while being interposed the first illumination part 341 therebetween.

The air jet part 361 prevents the vision camera 331, the first illumination part 341, and the second illumination part 351 from being polluted from the foreign materials. the air jet part 361 sprays air in a longitudinal direction of the vehicle body 1, and may form an air curtain corresponding to the vision camera 331, the first illumination part 341, and the second illumination part 351.

The air jet parts 361 are installed in both sides of lower ends of the mounting bracket 311 in a direction crossing the side panel 3 and the loop panel 5 while being interposed the grinded brazing bead 57 therebetween, respectively. The air jet part 361 may spray air in a cross direction in both sides of lower ends of the mounting bracket 311 at high speed to form the air curtain.

Further, the second air blower 371 sprays the air to a surface of the grinded brazing bead 57 to remove foreign materials included on the surface of the grinded brazing bead 57, and is installed at one surface of the mounting bracket 311.

Figure 12:
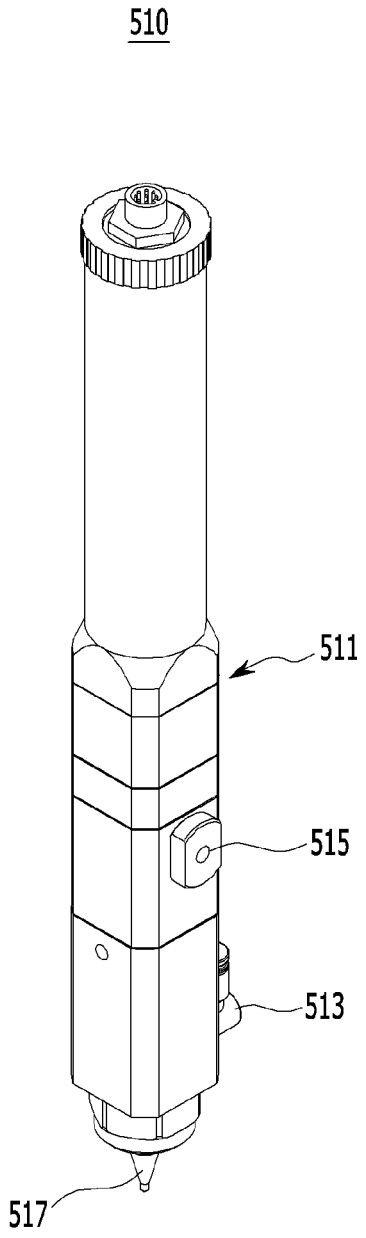
FIG. 12 is a perspective view illustrating a marker which is applied to a post-process tool for a roof laser brazing system according to an exemplary embodiment in the present disclosure.

FIG. 12 is a perspective view illustrating a marker which is applied to a post-process tool for a roof laser brazing system according to an exemplary embodiment in the present disclosure.

Referring to FIG. 9 to FIG. 12, in an exemplary embodiment in the present disclosure, the marker 510 sprays marking liquid to a failure part side of the brazing bead 57 detected by the bead inspector 310.

The marker 510 includes a marking body 511 which is installed in the bead inspector 310. The marking body 511 is installed at another surface of the mounting bracket 311 in the bead inspector 310. The marking body 511 may spray the marking liquid to the loop panel 5 corresponding to the failure part of the brazing bead 57.

The marking body 511 leans to a loop panel 5 side based on the brazing bead 57 in order to spray the marking liquid to the loop panel 5 corresponding to the failure part of the brazing bead 57, and is installed at another side of the mounting bracket 311.

The marking body 511 is configured by a structure capable of spraying the marking liquid as air pressure. To this end, the marking body 511 forms an air inlet 513 for injecting air, a marking liquid injecting part 515 for injecting the marking liquid, and a nozzle part 517 for injecting the marking liquid as air pressure.

Figure 13:
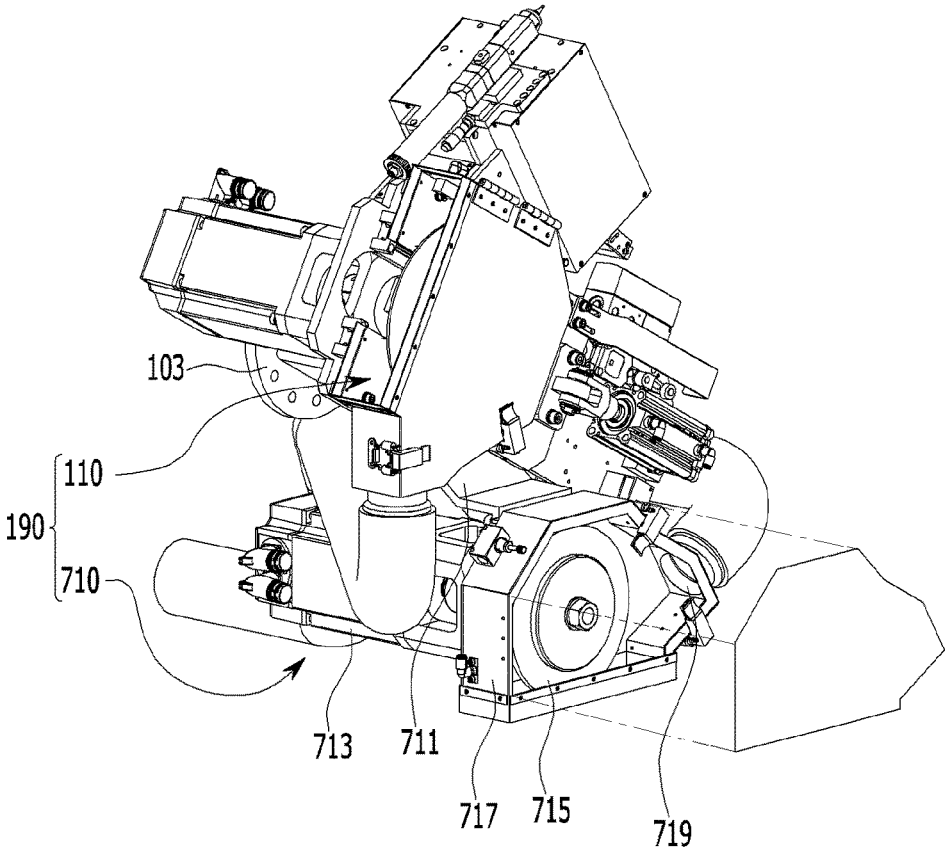
FIG. 13 is a perspective view illustrating a brushing assembly which is applied to a post-process tool for a roof laser brazing system according to an exemplary embodiment in the present disclosure.
Figure 14:
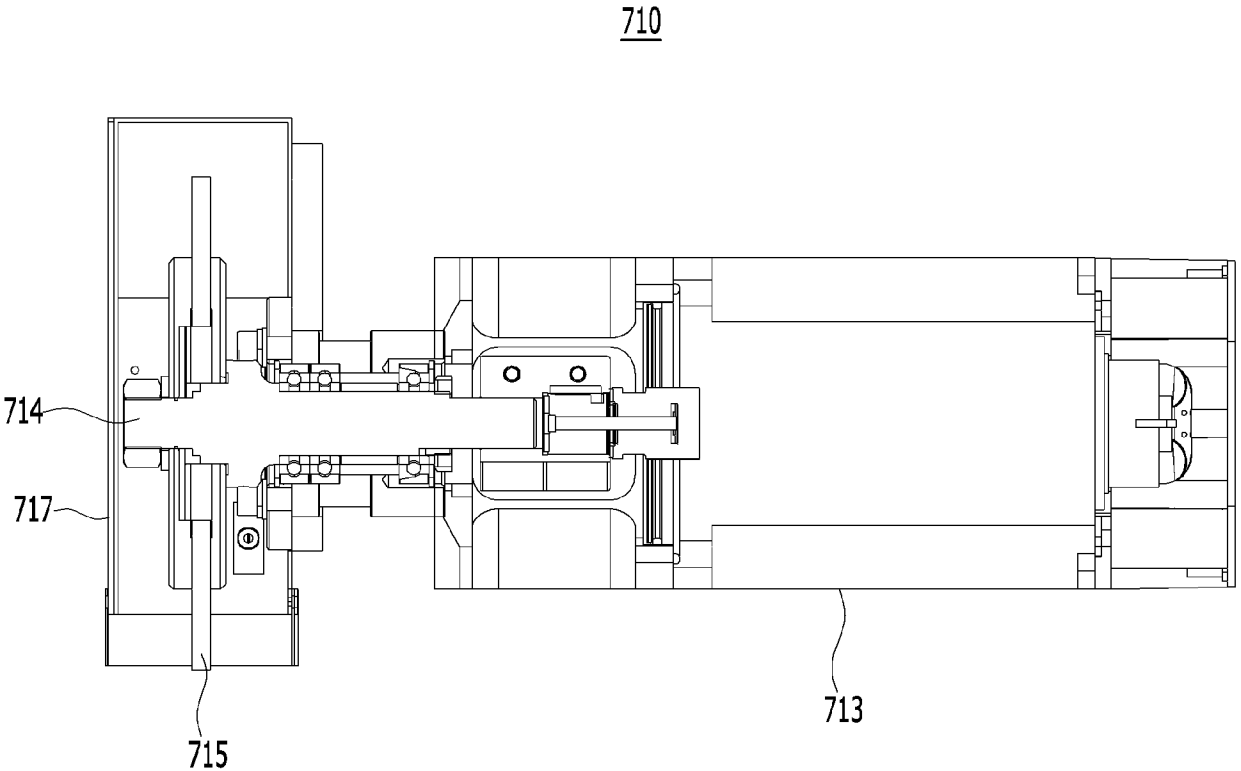
FIG. 14 is a sectional view illustrating a brushing assembly which is applied to a post-process tool for a roof laser brazing system according to an exemplary embodiment in the present disclosure.

FIG. 13 is a perspective view illustrating a brushing assembly which is applied to a post-process tool for a roof laser brazing system according to an exemplary embodiment in the present disclosure, and FIG. 14 is a sectional view of FIG. 13.

Referring to FIG. 13 and FIG. 14 together with FIG. 1 to FIG. 4, the brushing assembly 710 according to an exemplary embodiment in the present disclosure brushes the brazing bead 57 grinded by the grinding assembly 110.

The brushing assembly 710 may make a surface of the brazing bead 57 smooth and may remove an oxide film and soot included in the brazing bead 57 by moving and brushing the grinded brazing bead 57 in a longitudinal direction of the vehicle body 1 by a robot 101

The brushing assembly 710 may configure a polishing unit 190 together with the above grinding assembly 110.

The brushing assembly 710 is installed at another side of the fixing bracket 103. The brushing assembly 710 includes a brush bracket 711, a brush motor 713, a brush 715, and a brush cover 717.

The brush bracket 711 mounts various constituent elements to be described later, and is fixed to another side of the fixing bracket 103. The brush bracket 711 may be rotated together with the fixing bracket 103 by the robot 101.

The brush motor 713 rotates the brush 715 to be further described later, and fixed to the brush bracket 711. For example, the brush motor 713 may include a servo motor where control of rotation speed is easy.

The above 715 substantially brushes the grinded brazing bead 57. The brush 715 includes a plurality of brushes formed in a body having a disc shape, and is coupled with a drive shaft 714 of the brush motor 713.

The brush cover 717 covers the brush 715, is mounted at the brush bracket 711, and serves to collect a brushing dust scattered when the grinded brazing bead 57 is brushed through the brush 715.

The brush cover 717 encloses the whole part of the brush 715 coupled with a drive shaft 714 of the brush motor 713, serves as a housing with an open bottom end, and is fixed to the brush bracket 711.

The brush cover 717 is slippably moved in a longitudinal direction of the vehicle body 1 by the robot 101 in a state that a bottom end of the brush cover 717 makes contact with the side panel 3 and the loop panel 5.

In this case, the brush 715 is rotated in an inner side of the brush cover 717 by a brush motor 713, and may brush the brazing bead 57 through an open end of the brush cover 717.

Furthermore, the brush cover 717 is provided therein with an inlet 719 for sucking a brazing dust scatter when the brazing bead 57 is brushed by the brush 715. The inlet 719 sucks the brushing dust scattered inside the brush cover 717 to exhaust the sucked brushing dust to an outside of the brush cover 717. For example, the inlet 719 may be connected to a vacuum pump (not shown in the drawing) through a dust exhaust line (not shown in the drawing).

Hereinafter, an operation of the post-process tool 100 for a loop laser brazing system according to an exemplary embodiment in the present disclosure configured as described above will be described in detail with reference to the accompanying drawings.

First, an exemplary embodiment in the present disclosure regulates both side panels 3 of a vehicle body 1 transferred to a brazing section 8 of the loop laser brazing system 200 along the transfer line 7 through a side home position jig 10, and loads, home positions, and presses the loop panel 5 to both side panels 3 through a loop pressing jig 30.

In the above state, an exemplary embodiment in the present disclosure moves the brazing assembly 50 along a matching region between the both side panels 3 and the loop panel 5 through a brazing robot 51, and laser brazing laminates the matching region through the brazing assembly 50.

As described above, in the laser brazing laminating state of both side panels 3 and the loop panel 5 of the vehicle body, an exemplary embodiment in the present disclosure moves the vehicle body 1 to a post-process section 9 along a transfer line 7.

Next, an exemplary embodiment in the present disclosure positions a bead inspector 310 to a front side of the vehicle body 1 through a robot 101, and vision-captures a front glass mounting hole (not shown in the drawing) to output corresponding vision data to the controller 90.

Next, an exemplary embodiment in the present disclosure positions the bead inspector 310 to a rear side of the vehicle body 1 through the robot 101, and vision-captures a rear glass mounting hole (not shown in the drawing) to output corresponding vision data to the controller 90.

Accordingly, the controller 90 compares the vision data of the front glass mounting hole and the rear glass mounting hole with a preset reference value to calculate a grinding position compensation value of the grinding assembly 110 according to longitudinal direction and width direction distribution of the vehicle body 1 and reflect the position compensation value on a moving path of the robot 101.

After that, an exemplary embodiment in the present disclosure positions the grinding assembly 110 in a front side of the vehicle body 1 through the robot 101, and positions the grinding assembly 110 in a brazing bead 57 side of a lamination region between the both side panels 3 and the loop panel 5.

As described above, when the grinding assembly 110 is positioned at an initial grinding start part side, a stopper cylinder 180 of the grinding assembly 110 regulates the moving plate 160 by an advance operation of the stopper operation rod 181.

As described above, if the moving plate 160 is not regulated, the moving plate 160 is moved in a downward direction by the weight of the grinding motor 130. The grinding wheel 140 protrudes to a lower open end of the wheel cover 150. Accordingly, the protrusion region of the grinding wheel 140 may collide with the vehicle body 1.

In this case, a grinding surface of the grinding wheel 140 is positioned at a reference position, that is, a lower open end of a wheel cover 150 based on a location of the brazing bead 57. To this end, an exemplary embodiment in the present disclosure releases regulation of the moving plate 160 by a reverse operation of the stopper cylinder 180 in a location distant from the vehicle body. Accordingly, the moving plate 160 is moved in a downward direction by the weight of the grinding motor 130. In this state, an exemplary embodiment in the present disclosure positions a support means 910 to allow the grinding assembly 110 to be located away from the vehicle body 1. Accordingly, since external force is applied to the grinding wheel 140 through the support means 910 so that the moving plate 160 is moved in an upward direction, a grinding surface of the grinding wheel 140 is located at a reference position. In this case, a location of the moving plate 160 is fixed by an advance operation of the stopper cylinder 180.

Meanwhile, as described above, when the grinding assembly 110 is positioned in a grinding initial start part side, an exemplary embodiment in the present disclosure releases regulation of the moving plate 160 by a reverse operation of the stopper cylinder 180. Accordingly, the moving plate 160 is moved in a downward direction by the weight of the grinding motor 130, so that a grinding surface of the grinding wheel 140 presses the brazing bead 57 with a pressure according to the weight of the grinding motor 130.

In this case, the pressure control cylinder 170 of the grinding assembly 110 receives air pressure of Obar to 10bar through a proportional valve pressure controller 210 to apply the received air pressure to the moving plate 160 through a pressure control rod 171.

Accordingly, the pressure control cylinder 170 may control the grinding pressure of the grinding wheel 140 by the weight of the grinding motor 130 (e.g., 30 kgf) to a predetermined pressure for grinding (e.g., 6 kgf to 8 kgf) according to air pressure (e.g., for compensating pressure of 22 kgf to 24 kgf) provided through the proportional valve pressure controller 210.

Moreover, the pressure control cylinder 170 may compensate for a grinding position of the grinding wheel 140 according to position distribution of the vehicle body 1 to a height direction as air pressure provided by the proportional valve pressure controller 210.

Next, an exemplary embodiment in the present disclosure operates the grinding motor 130 to rotate the grinding wheel 140, moves the grinding wheel 140 along the brazing bead 57 to a rear side of the vehicle body 1 from a front side of the vehicle body 1 through the robot 101, and grinds the brazing bead 57. In addition, an exemplary embodiment in the present disclosure moves the grinding wheel 140 to the front side of the vehicle body 1 from the rear side of the vehicle body 1 through the robot 101, and grinds the brazing bead 57.

In the above procedure, a first air blower 157 of the grinding assembly 110 scatters the grinding dust generated when grinding the brazing bead 57 through the grinding wheel 140 to an inner side of the wheel cover 150 by air pressure.

Further, the grinding dust scattered at an inner side of the wheel cover 150 by the first air blower 157 is collected on a wheel cover 150 enclosing the grinding wheel 140, and an exemplary embodiment in the present disclosure may suck the grinding dust through the inlet 155 of the wheel cover 150 to exhaust the sucked grinding dust to an outside of the wheel cover 150.

Meanwhile, in an exemplary embodiment in the present disclosure, the front side and the rear side of the vehicle body 1 reciprocate through the grinding wheel 140 and the grinding wheel 140 is worn by grinding the brazing bead 57. Accordingly, a grinding surface of the grinding wheel 140 is located above the above reference position.

Accordingly, an exemplary embodiment in the present disclosure moves the grinding assembly 110 to a support means 910 side through the robot 101, and the moving plate 160 is moved in a downward direction by the weight of the grinding motor 130, and a grinding surface of the grinding wheel 140 is located under the reference position.

Accordingly, the moving plate 160 is moved in an upward direction, and the grinding surface of the grinding wheel 140 is located in the reference position by positioning the grinding assembly 110 in the support means 910. Next, an exemplary embodiment in the present disclosure regulates a position of the moving plate 160 by an advance operation of the stopper cylinder 180. Accordingly, an exemplary embodiment in the present disclosure may always and equally maintain the grinding working position constant regardless of an abrasion amount of the grinding wheel 140.

In the above procedure, a laser displacement sensor 230 of the grinding assembly 110 irradiate laser to an end portion of the moving plate 160 to receive the laser reflected from the end portion of the moving plate 160, and measures a moving displacement of the moving plate 160 to output the measurement value to the controller 90.

Accordingly, the controller 90 calculates an abrasion amount of the grinding wheel 140 based on the measurement value from the laser displacement sensor 230, and controls rotation speed of the grinding motor 130 when grinding the brazing bead 57 afterward.

Accordingly, an exemplary embodiment in the present disclosure may maintain line contact speed of the grinding surface according to abrasion of the grinding wheel 140 upon grinding the brazing bead 57 constant.

Meanwhile, when the above procedure is repeated and the brazing bead 57 is grinded, the grinding wheel 140 is worn, so that the moving plate 160 is gradually moved in a downward direction, and a bending part 253 of a dog plate 251 makes contact with a limit switch 250.

Accordingly, the limit switch 250 outputs a switching signal to the controller 90 by the dog plate 251, and the controller 90 displays abrasion presence and replacement presence of the grinding wheel 140 on a predetermined display (not shown in the drawing) according to the switching signal from the limit switch 250.

As described above, if the grinding of the brazing bead 57 is completed, an exemplary embodiment in the present disclosure positions the bead inspector 310 in a start part side of the grinded brazing bead 57 through the robot 101.

Next, an exemplary embodiment in the present disclosure moves the bead inspector 310 along the brazing bead 57 through the robot 101, and irradiates line laser in a direction crossing the side panel 3 and the loop panel 5 while being interposed the grinded brazing bead 57 therebetween through a line laser irradiator 321. In this case, the line laser irradiator 321 irradiates the line laser the brazing bead 57 side through an inspection hole 313 of a mounting bracket 311 in a lower side of the vision camera 331.

Simultaneously, an exemplary embodiment in the present disclosure vision-captures a surface of the brazing bead 57 and the line laser irradiated to a brazing bead 57 region from the line laser irradiator 321 through the vision camera 331 to output corresponding vision data to the controller 90.

In the above procedure, an exemplary embodiment in the present disclosure irradiates illumination light to a brazing bead 57 side through a first illumination part 341, and irradiates the illumination light to a peripheral portion of the grinded brazing bead 57 through a second illumination part 351.

Further, an exemplary embodiment in the present disclosure sprays air to a surface of the brazing bead 57 through a second air blower 371 to remove foreign materials included on the surface of the brazing bead 57. In addition, an exemplary embodiment in the present disclosure may prevent the vision camera 331, the first illumination part 341, and the second illumination part 351 from being polluted from the foreign materials by spraying air in a longitudinal direction of the vehicle body 1 through an air jet part 361 to form an air curtain corresponding to the vision camera 331, the first illumination part 341, and the second illumination part 351.

The controller 90 may calculate a surface of a brazing bead 57 provided from the vision camera 331 and a width and a height of the brazing bead 57 from the vision data of line laser and may compare the calculation value with a preset reference value to detect whether the brazing bead 57 fails.

In this case, the controller 90 may detect a surface of the brazing bead 57 provided from the vision camera 331 and short, a pore, displacement, depression, and height failure of the brazing bead 57 from the vision data of the line laser.

As described above, during a procedure of detecting a failure part of the brazing bead 57 through the bead inspector 310, an exemplary embodiment in the present disclosure sprays a marking liquid to a failure part side of the brazing bead 57 through a marking body 511 of the marker 510.

The marking body 511 sprays the marking liquid injected through the marking liquid inlet 515 through a nozzle part 517 as air pressure injected through an air inlet 513. In this case, the marking body 511 sprays the marking liquid to a loop panel 5 corresponding to the failure part of the brazing bead 57.

In the above state, an exemplary embodiment in the present disclosure positions the brushing assembly 710 in a start part side of the grinded brazing bead 57 through the robot 101. Next, an exemplary embodiment in the present disclosure moves the brushing assembly 710 along the brazing bead 57 through the robot 101, rotates the brush 715 through the brush motor 713, and brushes a surface of the brazing bead 57.

During the above procedure, an exemplary embodiment in the present disclosure may collect a brushing dust generated upon brushing the brazing bead 57, and may suck the brushing dust through an inlet 719 of the brush cover 717 to exhaust the sucked brushing dust to an outside of the brush cover 717.

As described above, the post-process tool 100 for the loop laser brazing system according to an exemplary embodiment in the present disclosure may perform grinding, quality inspection, marking and brushing of a failure part of the brazing bean in a laser brazing lamination post-process.

Accordingly, an exemplary embodiment in the present disclosure may perform grinding, quality inspection, marking and brushing of a failure part of the brazing bean to ensure excellent quality of the loop laser brazing bead.

Further, since an exemplary embodiment in the present disclosure may simultaneously perform grinding, quality inspection, marking and brushing of a failure part of the brazing bean, light-weight and simplification of the whole equipment can be obtained, and an initial investment cost may be reduced.

In addition, since an exemplary embodiment in the present disclosure may compensate for a position of a grinding assembly according to height direction, longitudinal direction, and width direction position distribution through a vertical direction floating structure and a pressure compensation structure of a grinding assembly, and a vision camera of a bead inspector, grinding quality of the brazing bead according to vehicle body position distribution may be ensured.

Moreover, an exemplary embodiment in the present disclosure may automatically detect processing failure of a loop laser brazing bead through a bead inspector. Visual confirmation of a worker is easy in a repair process by marking a loop panel of a failure part. Quality traceability of the loop laser brazing bead is possible.

While this disclosure has included description of what is presently considered to be practical exemplary embodiments, it is to be understood that the inventive concept is not limited to the disclosed embodiments, but, on the contrary, is intended to cover various modifications and equivalent arrangements included within the spirit and scope of the appended claims.

What is claimed is:

1. A post-process tool comprising:

a fixing bracket mounted in at least one robot; and a grinding assembly installed at one side of the fixing bracket, being moved in a longitudinal direction of the vehicle body, and configured to grind a lamination region, wherein the grinding assembly comprises a grinding bracket mounted at the one side of the fixing bracket, a grinding motor reciprocatably installed in the grinding bracket and moving in upward and downward directions; and a grinding wheel coupled to a drive shaft of the grinding motor.

2. The post-process tool of claim 1, wherein:

the grinding assembly comprises:

a moving plate connected with the drive shaft of the grinding motor through a bushing reciprocatably installed in the grinding bracket and moving in upward and downward directions; and a wheel cover fixed to the grinding bracket, and covering the grinding wheel.

3. The post-process tool of claim 2, wherein:

a pair of rail blocks are installed in upward and downward directions in the grinding bracket, and the moving plate comprises a sliding block slidably coupled with the rail blocks.

4. The post-process tool of claim 3, wherein:

the moving plate is disposed between the grinding bracket and a wheel cover, and a guide groove for guiding the bushing in upward and downward directions is formed in the grinding bracket.

5. The post-process tool of claim 2, wherein:

the wheel cover comprises:

an inlet sucking a grinding dust scattered by the grinding wheel; and an air blower removing foreign materials of the laminated region.

6. The post-process tool of claim 2, wherein:

the grinding assembly comprises:

a virtual pressure control cylinder installed in the grinding bracket and connected with the moving plate, and controlling grinding virtual pressure of the grinding wheel; and a stopper cylinder installed in the grinding bracket and selectively limiting a motion of the moving plate.

7. The post-process tool of claim 6, wherein the fixing bracket comprises a proportional valve pressure controller controlling air pressure provided to the virtual pressure control cylinder to compensate for a grinding position of the grinding wheel in upward and downward directions and to compensate for the grinding virtual pressure of the grinding wheel.

8. The post-process tool of claim 7, wherein:

the proportional valve pressure controller controls air pressure of the virtual pressure control cylinder under control of a controller, and the virtual pressure control cylinder controls the grinding virtual pressure of the grinding wheel by a grinding position of the grinding wheel and a weight of the grinding motor to a preset virtual pressure as air pressure.

9. The post-process tool of claim 6, wherein the grinding bracket comprises a laser displacement sensor configured to measure a vertical moving displacement of the moving plate to output a corresponding measurement value to a controller.

10. The post-process tool of claim 9, wherein:

the controller calculates an abrasion amount of the grinding wheel based on the measurement value from the laser displacement sensor, and controls a rotation speed of the grinding motor based on the abrasion amount of the grinding wheel.

11. The post-process tool of claim 6, wherein:

a dog plate is vertically installed in the moving plate, a limit switch configured to confirm abrasion presence of the grinding wheel is installed in the grinding bracket, and the limit switch outputs a switching signal to a controller by the dog plate.

12. The post-process tool of claim 6, wherein:

the stopper cylinder comprises an operation rod which advances and backs up in the moving plate side through the grinding bracket, and a friction pad is installed in the moving plate corresponding to a front end of the operation rod.

13. A post-process tool comprising:

a fixing bracket mounted in at least one robot;

a bead inspector installed at one side of the fixing bracket, and inspecting a laminated region grinded by the grinding assembly while being moved in a longitudinal direction of the vehicle body by the robot; and a marker installed in the bead inspector and spraying a marking liquid to a failure part side of the laminated region detected by the bead inspector.

14. The post-process tool of claim 13, wherein the bead inspector measures a position of the vehicle body based on a front glass mounting hole and a rear glass mounting hole of the vehicle body to output the measured position to a controller before grinding the laminated region through the grinding assembly.

15. The post-process tool of claim 14, wherein the controller calculates a grinding position compensation value of the grinding assembly based on the measured position of the vehicle body from the bead inspector to reflect the calculated grinding position compensation value on a moving path of the robot.

16. The post-process tool of claim 13, wherein:

the bead inspector comprises:

a mounting bracket installed in another side of the fixing bracket;

a line laser irradiator installed in the mounting bracket and configured to irradiate a line laser in a direction crossing a side panel and a loop panel of the vehicle body while being interposed the laminated region therebetween; and a vision camera configured to vision-capture the grinded laminated region to control corresponding vision data to a controller.

17. The post-process tool of claim 16, wherein:

the bead inspector comprises:

a first illumination part having a ring shape fixed to the mounting bracket in a lower side of the vision camera and irradiating illumination light to the laminated region; and second illumination parts having a bar shape fixed to both sides of the mounting bracket in a longitudinal direction of the vehicle body in a lower side of the first illumination part, respectively, while being interposed the first illumination part therebetween and irradiating the illumination light to the grinded laminated region.

18. The post-process tool of claim 17, wherein the bead inspector comprises air jet parts installed in both Sides of a bottom end of the mounting bracket in a direction crossing a side panel and a loop panel of the vehicle body respectively, while being interposed the grinded laminated region, and spraying air in a longitudinal direction of the vehicle body and forming an air curtain corresponding to the vision camera, the first illumination part and the second illumination part.

19. The post-process tool of claim 18, wherein the bead inspector comprises an air blower installed in one side of the mounting bracket and configured to spray air to the grinded laminated region.

20. The post-process tool of claim 16, wherein the line laser irradiator is inclined with respect to the mounting bracket in a downward direction, and irradiates liner laser to a lower side of the vision camera.

21. The post-process tool of claim 16, wherein:

the controller compares vision data of a surface and the line laser of the grinded brazing bead provided from the vision camera with a preset reference valueto detect short, pore, displacement, depression, and height failure of the grinded laminated region.

22. The post-process tool of claim 13, wherein the vision camera measures a position of the vehicle body based on a front glass mounting hole and a rear glass mounting hole of the vehicle body to output the measured position to a controller before grinding the laminated region through the grinding assembly.

23. The post-process tool of claim 22; wherein:

the controller compares vision data of the front glass mounting hole and the rear glass mounting hole with a preset reference value and calculates a grinding position compensation value of the grinding assembly in a longitudinal direction and a width direction of the vehicle body to reflect the calculated grinding position compensation value on a moving path of the robot.

24. The post-process tool of claim 13, wherein the marker comprises a marking body installed in the bead inspector, and sprays a marking liquid to a loop panel corresponding to a failure part of the laminated region.

25. The post-process tool of claim 13, wherein the marker comprises a marking body comprising an air inlet installed in another side of the mounting bracket and spraying air and a nozzle part spraying a marking liquid.

26. The post-Process tool of claim 25, wherein the marking body leans to a loop panel side based on the grinding laminated region and is installed in another side of the mounting bracket.

27. A post-process tool comprising:

a fixing bracket mounted in at least one robot;

a grinding assembly installed at one side of the fixing bracket, being moved in a longitudinal direction of the vehicle body, and grinding a lamination region;

a bead inspector installed in another side of the fixing bracket, and inspecting a laminated region grinded by the grinding assembly while being moved in a longitudinal direction of the vehicle body by the robot; and a marker installed in the bead inspector and spraying a marking liquid to a failure part side of the laminated region detected by the bead inspector.

28. The post-process tool of claim 27, further comprising a brushing assembly installed in another side of the fixing bracket, and brushing the grinded laminated region by the grinded assembly while being moved in a longitudinal direction of the vehicle body by the robot.

29. The post-process tool of claim 28, wherein:

the brushing assembly comprises:

a brush bracket mounted in another side of the fixing bracket;

a brush motor installed in the brush bracket;

a brush coupled with the brush motor; and a brush cover Mounted in the brush bracket and covering the brush.

30. The post-process tool of claim 29, wherein the brush cover comprises an inlet sucking a brushing dust scattered by the brush.

* * * * *